US010046875B2

(12) United States Patent
Cavazza et al.

(10) Patent No.: US 10,046,875 B2
(45) Date of Patent: Aug. 14, 2018

(54) PACKING MACHINE AND PACKING METHOD FOR PRODUCING AN INNER CONTAINER OF A SLIDE-OPEN PACKAGE OF TOBACCO ARTICLES

(71) Applicant: G.D SOCIETA' PER AZIONI, Bologna (IT)

(72) Inventors: Luca Cavazza, Bologna (IT); Valeria Capelli, Casalecchio di Reno (IT); Cristian Dakessian, Bologna (IT); Michele Squarzoni, Ferrara (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 473 days.

(21) Appl. No.: 14/653,310

(22) PCT Filed: Dec. 23, 2013

(86) PCT No.: PCT/IB2013/061294
§ 371 (c)(1),
(2) Date: Jun. 18, 2015

(87) PCT Pub. No.: WO2014/097276
PCT Pub. Date: Jun. 26, 2014

(65) Prior Publication Data

US 2015/0336697 A1 Nov. 26, 2015

(30) Foreign Application Priority Data

Dec. 21, 2012 (IT) ..... BO2012A0700

(51) Int. Cl.
*B65B 19/20* (2006.01)
*B65B 43/10* (2006.01)
*B65B 19/22* (2006.01)

(52) U.S. Cl.
CPC ..... *B65B 19/20* (2013.01); *B65B 19/22* (2013.01); *B65B 19/223* (2013.01); *B65B 19/228* (2013.01); *B65B 43/10* (2013.01)

(58) Field of Classification Search
CPC ..... B65B 19/20; B65B 19/22; B65B 19/223; B65B 19/228; B65B 43/10
See application file for complete search history.

(56) References Cited

U.S. PATENT DOCUMENTS 3,933,299 A 1/1976 Shimada et al.
3,979,047 A 9/1976 Focke et al.
(Continued)

FOREIGN PATENT DOCUMENTS

EP 0900646 A1 3/1999
EP 2030896 A1 * 3/2009 ..... B65B 19/20
(Continued)

OTHER PUBLICATIONS

International Search Report and Written Opinion, International Application No. PCT/IB2013/061294, dated Apr. 1, 2014.
(Continued)

*Primary Examiner* — Thanh Truong
*Assistant Examiner* — Thomas Wittenschlaeger
(74) *Attorney, Agent, or Firm* — Marshall, Gerstein & Borun LLP

(57) ABSTRACT

Packing machine and packing method for producing an inner container of a slide-open package of tobacco articles by folding an inner blank about a wrapped group of tobacco articles; the inner blank is folded, by way of first folding means, so as to form a hinged lid; in a feed station, the partly folded inner blank is coupled to the wrapped group of tobacco articles so that a rear wall of the wrapped group of tobacco articles rests on a panel of the inner blank corresponding to a rear wall of the inner container; and the inner
(Continued)

blank is folded, by second folding means arranged downstream from the feed station, about the wrapped group of tobacco articles to complete the production of the inner container.

12 Claims, 25 Drawing Sheets

(56) References Cited

U.S. PATENT DOCUMENTS 4,034,538 A * 7/1977 Schmermund ..... B65B 19/226 53/148
4,188,024 A 2/1980 Seragnoli
4,392,338 A * 7/1983 Fox ..... B65B 19/20 206/268
4,487,596 A 12/1984 Livens et al.
4,559,758 A * 12/1985 Gamberini ..... B65B 19/223 53/207
4,947,617 A * 8/1990 Focke ..... B65B 11/004 53/202
5,070,681 A * 12/1991 Romagnoli ..... B65B 5/024 53/566
5,133,170 A * 7/1992 Lewis ..... B65B 19/20 53/252
5,193,328 A 3/1993 Boriani et al.
5,588,281 A * 12/1996 Boriani ..... B65B 19/20 53/443
6,085,494 A * 7/2000 Lembke ..... B65B 11/004 53/228
6,206,815 B1 * 3/2001 Focke ..... B65B 19/228 493/55
6,789,370 B2 * 9/2004 Spatafora ..... B65B 19/225 493/151
7,240,469 B2 * 7/2007 Ghini ..... B65B 19/20 53/234
7,347,033 B2 * 3/2008 Gamberini ..... B65B 19/16 53/148
7,625,334 B2 * 12/2009 Corsini ..... B65B 19/228 493/162
9,701,429 B2 * 7/2017 Squarzoni ..... B65B 11/58
2011/0041463 A1 * 2/2011 Squarzoni ..... B65B 19/223 53/461
2014/0305080 A1 10/2014 Squarzoni

FOREIGN PATENT DOCUMENTS

EP 2125573 A1 12/2009
WO WO-2013/068951 A1 5/2013

OTHER PUBLICATIONS

International Preliminary Report on Patentability, International Application No. PCT/IB2013/061294, dated Jun. 23, 2015.

* cited by examiner

PACKING MACHINE AND PACKING METHOD FOR PRODUCING AN INNER CONTAINER OF A SLIDE-OPEN PACKAGE OF TOBACCO ARTICLES

CROSS-REFERENCE TO RELATED APPLICATIONS

This is the U.S. national phase of PCT/IB2013/061294, filed Dec. 23, 2013, which claims the benefit of Italian Patent Application No. BO2012A000700, filed Dec. 21, 2012.

TECHNICAL FIELD

The present invention relates to a packing machine and a packing method for producing an inner container of a slide-open package of tobacco articles.

PRIOR ART

The rigid packages of cigarettes of the type with a hinged lid are currently the most widespread cigarette packages in the market as they are of simple construction, easy and practical to use and offer good mechanical protection to the cigarettes contained within.

Besides the aforementioned rigid packages of cigarettes with a hinged lid, packages of cigarettes have been proposed with rigid slide-open (or sliding) covers comprising two containers inserted one inside the other in a separable way. In other words, a package of cigarettes with rigid slide-opening comprises an inner container, which is adapted to accommodate a wrapped group of cigarettes in a wrapping sheet of metalized paper and is housed within an outer container so as to be able to slide with respect to the outer container itself between a closed configuration, wherein the inner container is inserted inside the outer container, and an open configuration, wherein the inner container is extracted from the outer container.

Also proposed was a rigid slide-open package of cigarettes and with a hinged lid, wherein the inner container (or, alternatively, the outer container) is provided with a hinged lid to rotate between a closed position and an open position of an open top end of the inner container. The lid has a connecting tab that at one end is integral with the lid and at the opposite end is integral with the outer container (or, alternatively, to the inner container) to control "automatically" (i.e. without the user having to touch the lid) the rotation of the lid by sliding the inner container with respect to the outer, container.

In particular, in a rigid package of cigarettes of the slide-opening type and with a hinged lid the connecting tab which "automatically" controls the rotation of the lid has a top end that is integral with a top or rear wall of the lid and a bottom end that, during the opening of the package of cigarettes, couples with a coupling tongue integral with a rear wall of the outer container.

It was observed that the known current mode used for producing the packages of cigarettes of the slide-opening type and with a hinged lid does not allow to achieve high productivity (i.e. a high number of packages of cigarettes produced per unit of time), especially if it is necessary to maintain a high quality standard. Consequently, the known packing machines used for producing packages of cigarette of the slide-open type and with a hinged lid are excessively slow and suitable to produce only limited batches for special series.

Additionally, but not less important, the known packing machines used for producing packages of cigarettes of the slide-opening type and with a hinged lid are not "flexible", i.e. it is very complicated to modify a packing machine which produces a certain type of slide-opening cigarette package (with or without a hinged lid) to produce another type of slide-opening cigarette package (with or without a hinged lid).

The patent application US2011041463A1 describes a packing machine for cigarettes for producing a rigid package with hinged lid. The packing machine is provided with a first packing unit, which is adapted to fold a first blank about a group of cigarettes to form an outer container provided with a hinged lid, and a second packing unit, which is adapted to fold a second blank about the outer container to form a tubular slider arranged about the outer container to slide axially with respect to the outer container itself; the tubular slider is provided with a transmission element, which has a first end integral with the lid, a second end opposite the first end and integral with the slider, and an intermediate portion which is deformable and has an "U" fold arranged between the outer container and the slider.

DESCRIPTION OF THE INVENTION

Purpose of the present invention is to provide a packing machine and a packing method for producing an inner container of a slide-open package of tobacco articles and with a hinged lid, which machine and packing method are free from the drawbacks described above and, in particular, are simple and economical to produce.

According to the present invention, a packing machine and a packing method for producing an inner container of a slide-open package of tobacco articles, as claimed in the appended claims are provided.

BRIEF DESCRIPTION OF THE DRAWINGS

The present invention will now be described with reference to the accompanying drawings, which illustrate a non-limiting embodiment, wherein.

PREFERRED EMBODIMENTS OF THE INVENTION

Figure 1:
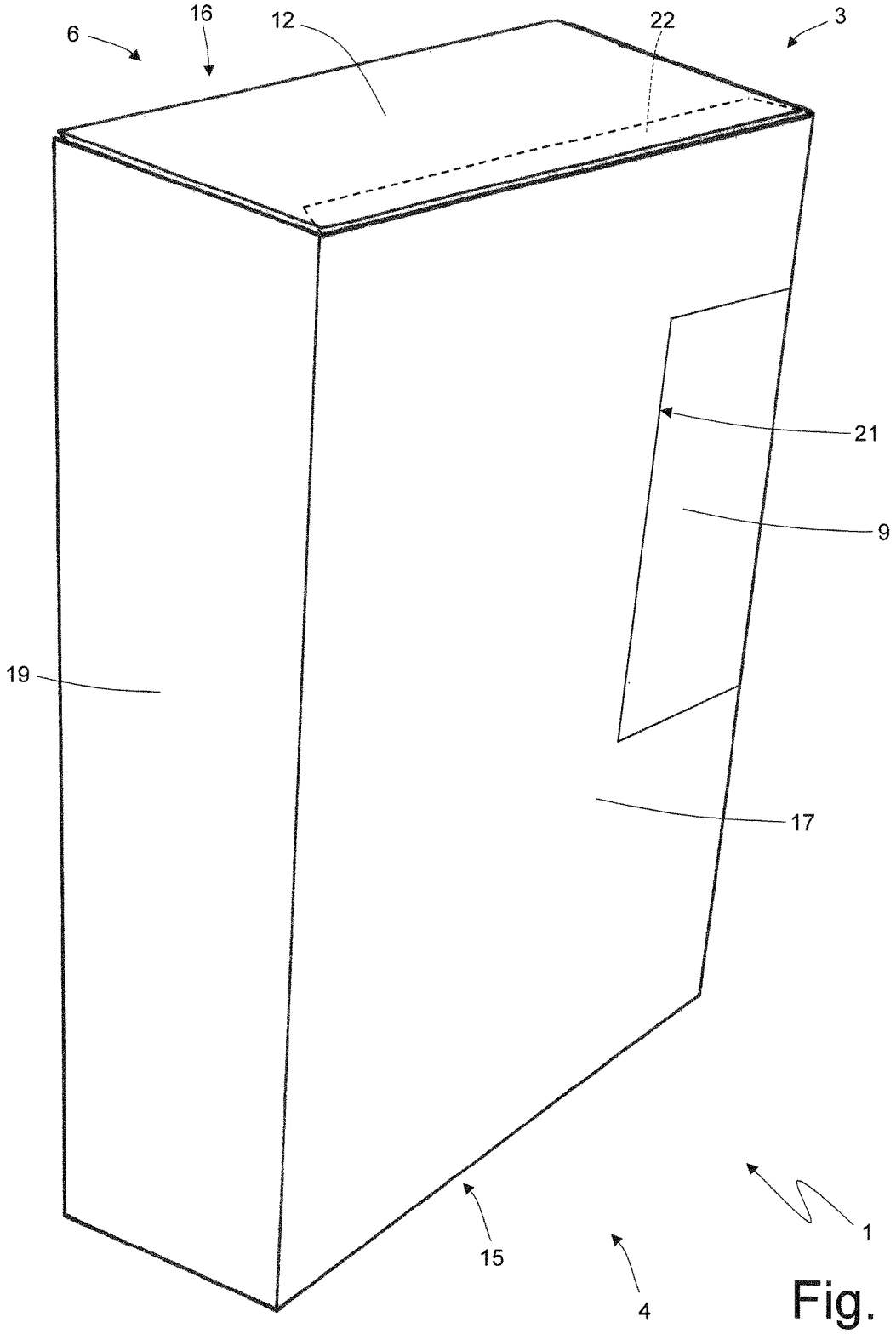
FIG. 1 is a front perspective view and in a closed configuration of a package of cigarettes of the rigid type with slide-opening and with a hinged lid.
Figure 2:
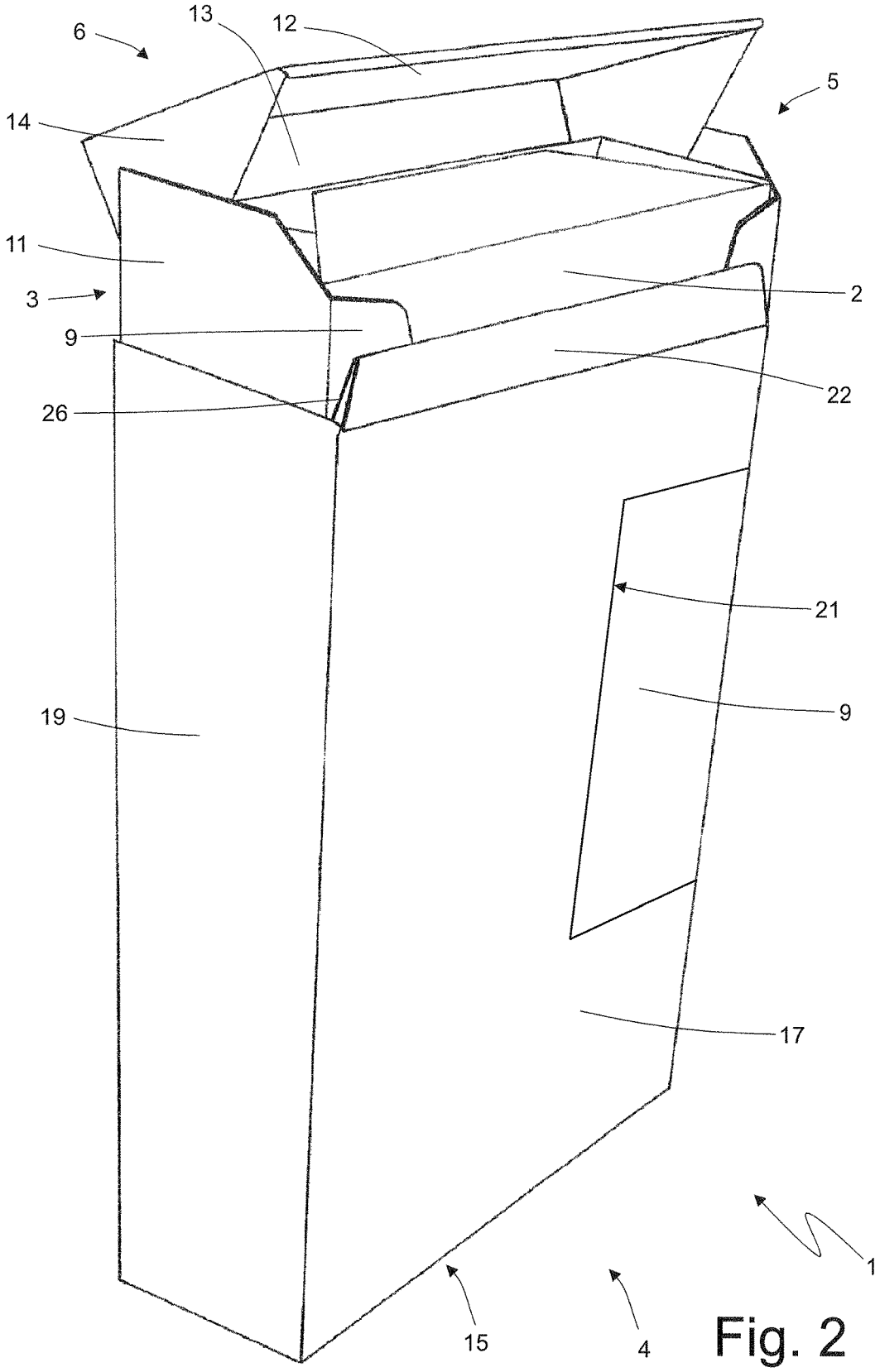
FIG. 2 is a front perspective view and in an open configuration of the package of cigarettes of FIG. 1.
Figure 3:
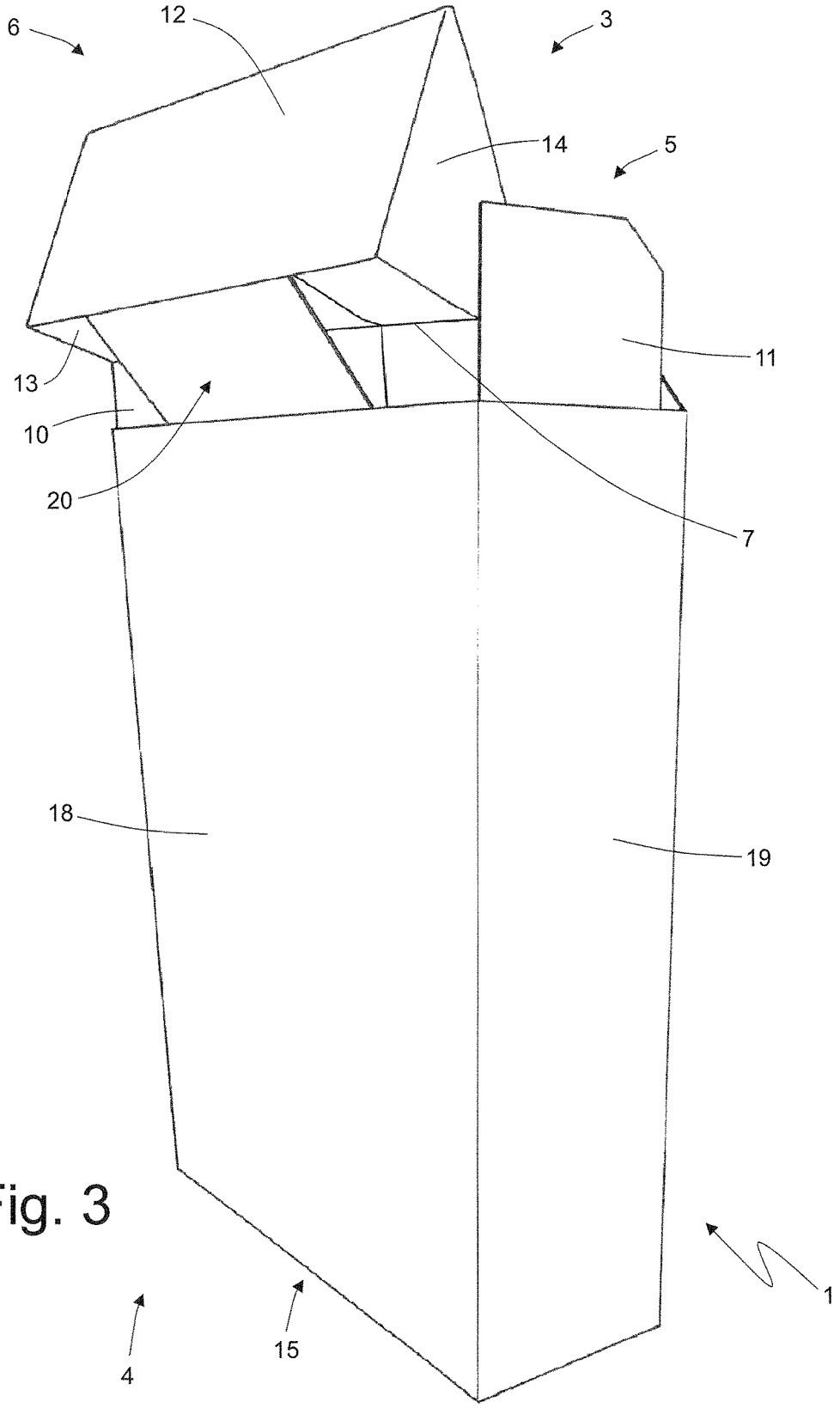
FIG. 3 is a rear perspective view and in an open configuration of the package of cigarettes of FIG. 1.

In FIGS. 1, 2 and 3, with the number 1 is indicated, as a whole, a rigid slide-open package of cigarettes by way of translation (linear movement).

The package 1 of cigarettes shown in FIG. 1 comprises a wrapped group 2 of cigarettes (visible schematically in FIG. 2), i.e. a group of cigarettes wrapped in a sheet of metalized wrapping paper. Also, the package 1 of cigarettes comprises an inner container 3 of the rigid type, inside of which the wrapped group 2 is directly placed, and an outer container 4 of the rigid type, which houses in a sliding manner the inner container 3 to allow the inner container 3 itself to slide with respect to the outer container 4 so as to move with a translational movement between a closed configuration (illustrated in FIG. 1), wherein the inner container 3 is fully inserted inside the outer container 4, and an open configuration (shown in FIGS. 2 and 3), wherein the inner container 3 is partially extracted from the outer container 4 and allows access to the wrapped group 2 of cigarettes.

The inner container 3 is cup-shaped and has an open upper end 5. Preferably, the container 3 has a parallelepiped shape with a rectangular cross section. Furthermore, the inner container 3 comprises a lid 6, which is cup-shaped and is hinged to the inner container 3 along a hinge 7 to rotate, with respect to the inner container 3, between an open position (shown in FIGS. 2 and 3) and a closed position (shown in FIG. 1) of the open upper end 5.

Figure 4:
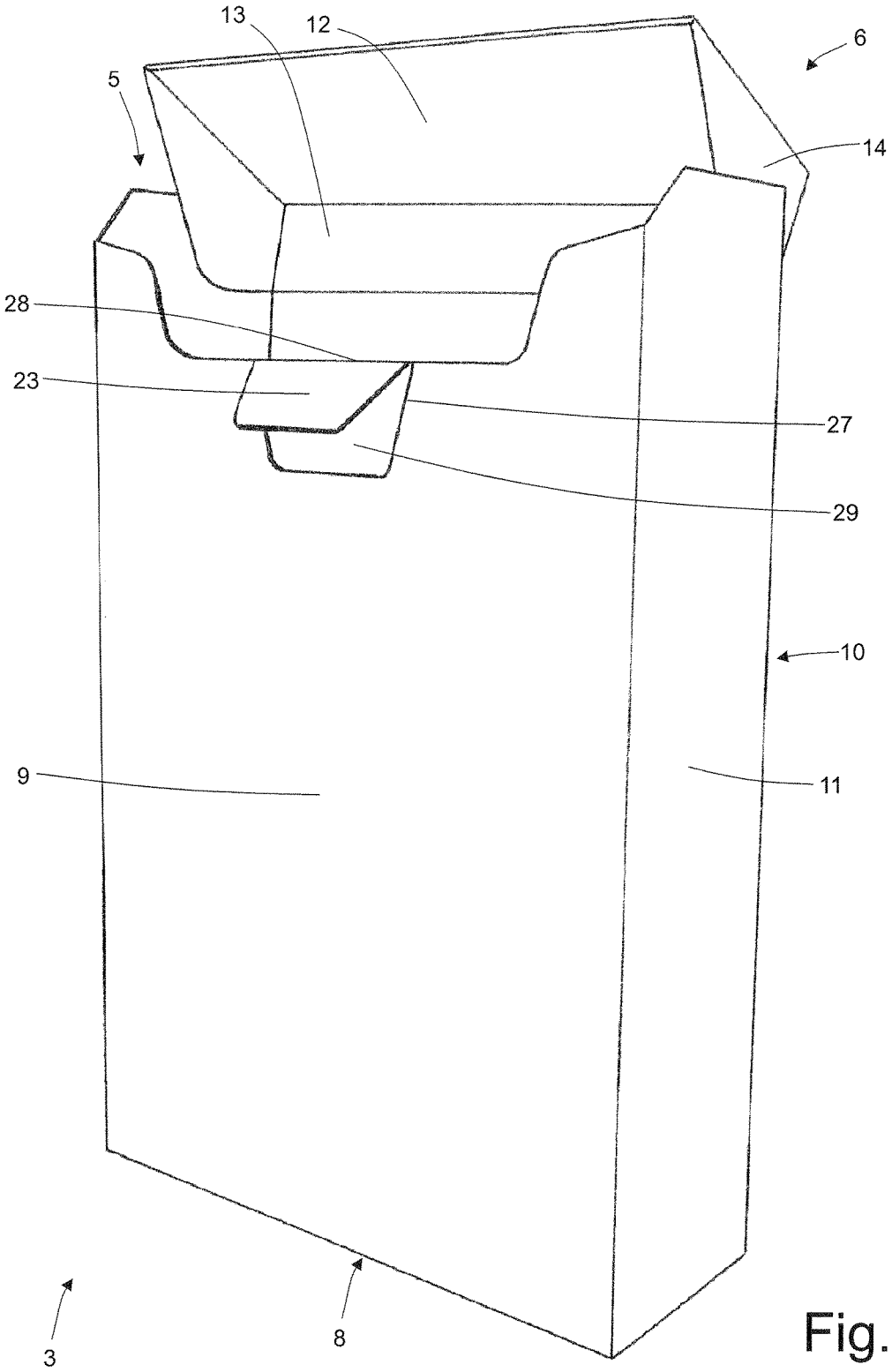
FIG. 4 is a front perspective view of an inner container of the package of cigarettes of FIG. 1.
Figure 5:
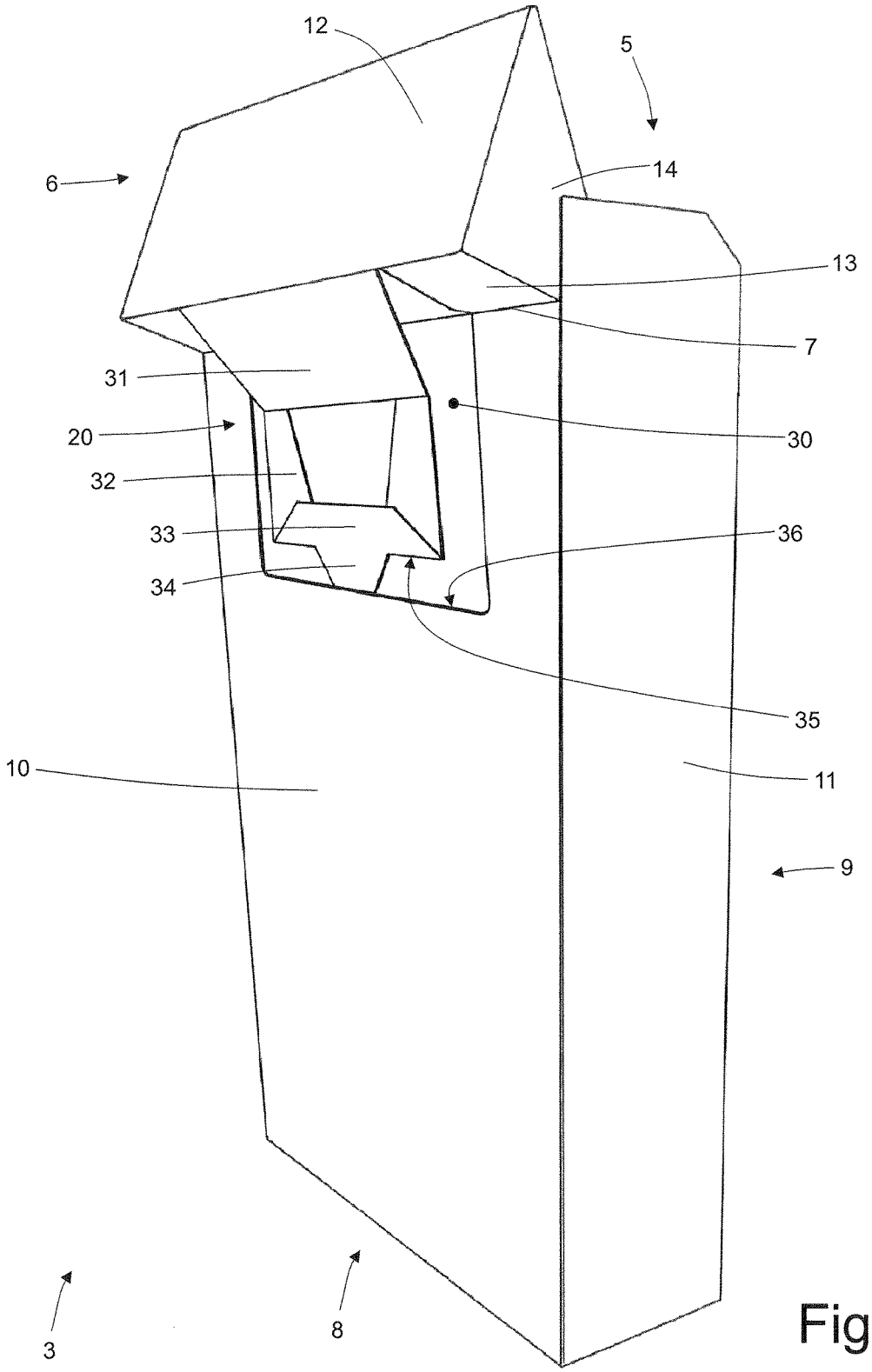
FIG. 5 is a rear perspective view of the inner container of FIG. 4.

As shown more clearly in FIGS. 4 and 5, the inner container 3 has a bottom wall 8 opposite to the open upper end 5, a front wall 9 and a rear wall 10 parallel and opposite one to the other, and two lateral walls 11 parallel to each other and interposed between the walls 9 and 10. Between the walls 9 and and the lateral walls 11 are defined four longitudinal edges while between the walls 9, 10 and 11 and the bottom wall 8 are defined four transverse edges.

The lid 6 is cup-shaped and has a top wall 12 (which, when the lid 6 is in the closed position, is opposite and parallel to the bottom wall 8 of the inner container 3), a rear wall 13 which is connected with the rear wall 10 of the inner container 3 by way of the hinge 7, and two lateral walls 14 parallel one to the other. It is important to note that the lateral walls 14 of the lid 6 are arranged inside the lateral walls 11 of the inner container 3 as is clearly illustrated in FIGS. 4 and 5.

As illustrated in FIGS. 1, 2, 3 and 6, the outer container 4 is cup-shaped, is of parallelepiped shape with rectangular cross section, and has a bottom wall 15 opposite to an open top end 16, a front wall 17 and a rear wall 18 opposite and parallel with respect to each other, and two lateral walls 19 parallel one to the other and interposed between the walls 17 and 18. Between the walls 17 and 18 and the lateral walls 19 four longitudinal edges are defined while between the walls 17, 18 and 19 and the bottom wall 15 four transverse edges are defined.

In the embodiment illustrated in the attached figures, all the edges are straight; according to alternative embodiments not illustrated, some edges (longitudinal and/or transverse) may be beveled or rounded.

As illustrated in FIG. 3, the rear wall 13 of the lid 6 (in particular a top edge of the rear wall 13 of the lid 6 which delimits the rear wall 13 from the top wall 12) is connectable to the rear wall 18 of the outer container 4 by way of a connecting tab 20 to "automatically" control (i.e. without the user having to touch the lid 6) the rotation of the lid 6 by way of the sliding of the inner container 3 with respect to the outer container 4. In other words, thanks to the connecting tab 20 that mechanically couples the rear wall 13 of the lid 6 to the rear wall 18 of the outer container 4, when the inner container 3 slides with respect to the outer container 4 from the closed configuration to the open configuration, the lid 6 is pushed by the inner container 3 from the closed position to the open position in an "automatic" way (i.e. without the user having to touch the lid 6); similarly, when the inner container 3 slides with respect to the outer container 4 from the open configuration to the closed configuration, the lid 6 is pushed by the inner container 3 from the open position to the closed position in an "automatic" way (i.e. without the user having to touch the lid 6). In this way, the user only needs to apply the necessary thrust to slide the inner container 3 with respect to the outer container 4 without having to touch the lid 6 as its rotation is "automatically" controlled.

In the embodiment illustrated in the attached figures, the outer container 4 has a through window 21 that is formed astride the front wall 17 and of a lateral wall 19 and through which the front wall 9 of the container 3 is accessible to allow the application of a thrust to the inner container 3 in order to move the inner container 3 between the closed configuration and the open configuration.

As shown in FIG. 2, the outer container 4 comprises a sealing tab 22 that has the function of preventing the undesirable loss of tobacco dust through the gap that remains between the front edge of the top wall 12 of the lid 6 of the inner container 3 and the corresponding upper edge of the front wall 17 of the outer container 4. The sealing tab 22 is hinged to the upper edge of the front wall 17 of the outer container 4 and is movable between a working position (which is illustrated in FIG. 1 and is assumed in the closed configuration, or when the inner container 3 is fully inserted in the outer container 4) and a rest position (which is illustrated in FIG. 2 and is assumed in the open configuration, i.e. when the inner container 3 is partially extracted from the outer container 4). In the working position, the sealing tab 22 is perpendicular to the front wall 17 of the outer container 4 and is arranged below the top wall 12 of the lid 6 of the inner container 3 so as to block the escape of tobacco dust by "sealing" the gap that remains between the front edge of the top wall 12 of the lid 6 of the inner container 3 and the facing upper edge of the front wall 17 of the outer container 4. In the rest position (as clearly illustrated in FIG. 2), the sealing tab 22 is parallel to the front wall 17 of the outer container 4 not thereby disrupting the relative movement between the inner container 3 the and outer container 4.

Figure 6:
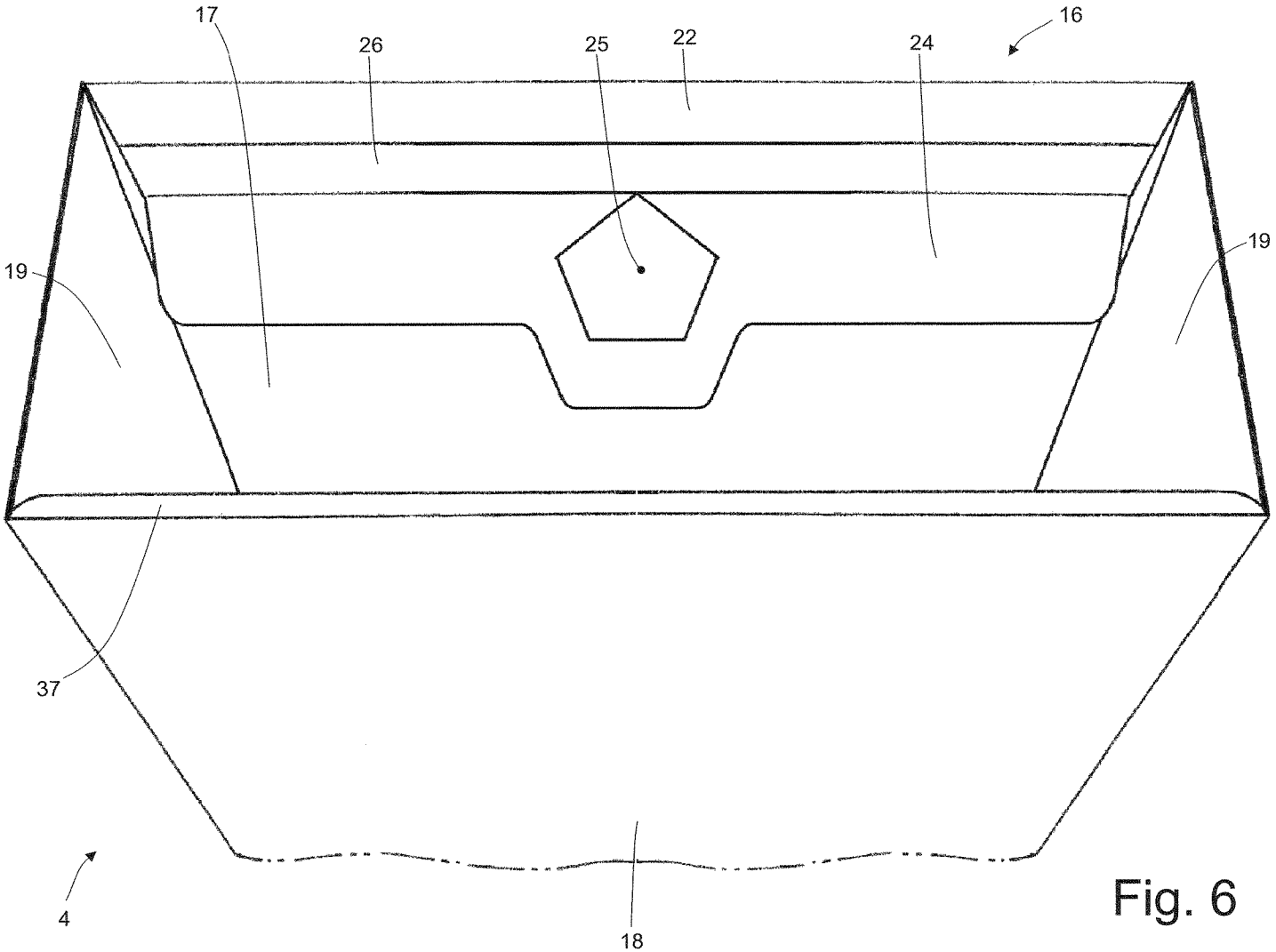
FIG. 6 is a top perspective view of an outer container of the package of cigarettes of FIG. 1.

As illustrated in FIG. 4, the inner container 3 comprises an actuating tab 23 which is integral with the front wall 9 of the inner container 3 and protrudes towards the front wall 17 of the outer container 4. As illustrated in FIG. 6, the outer container 4 comprises an actuating tab 24 which is mechanically connected to the sealing tab 22 and is arranged between the front wall 17 of the outer container 4 and the front wall 9 of the inner container 3 to engage (or hook) with the actuating tab 23 when the inner container 3 moves towards the rest position so as to pull the sealing tab 22 in the rest position by exploiting the movement of the inner container 3. In other words, when the inner container 3 moves towards the closed configuration the movement of the inner container 3 brings the actuating tab 23 integral with the front wall 9 of the inner container 3 to hook the actuating tab 24, and then to push the actuating tab 24 itself downwards, and when the actuating tab 23 pushes downwards the actuating tab 24, the actuating tab 24 pulls, therefore, the sealing tab 22 towards the working position.

As illustrated in FIG. 6, the actuating tab 24 has a center through window 25 through which the actuating tab 23 is arranged; i.e. the actuating tab 23 enters the through window 25 of the actuating tab 24 to hook the actuating tab 24 and drag (push) the actuating tab 24 itself. According to a preferred embodiment, the actuating tab 24 is connected to the sealing tab 22 by way of a connecting tab 26 which on one side is hinged to the actuating tab 24 (i.e. is connected to the actuating tab 24 along a fold line that allows a relative rotation) and the opposite side is hinged to the sealing tab (that is connected to the sealing tab 22 along a fold line which allows relative rotation).

Figure 7:
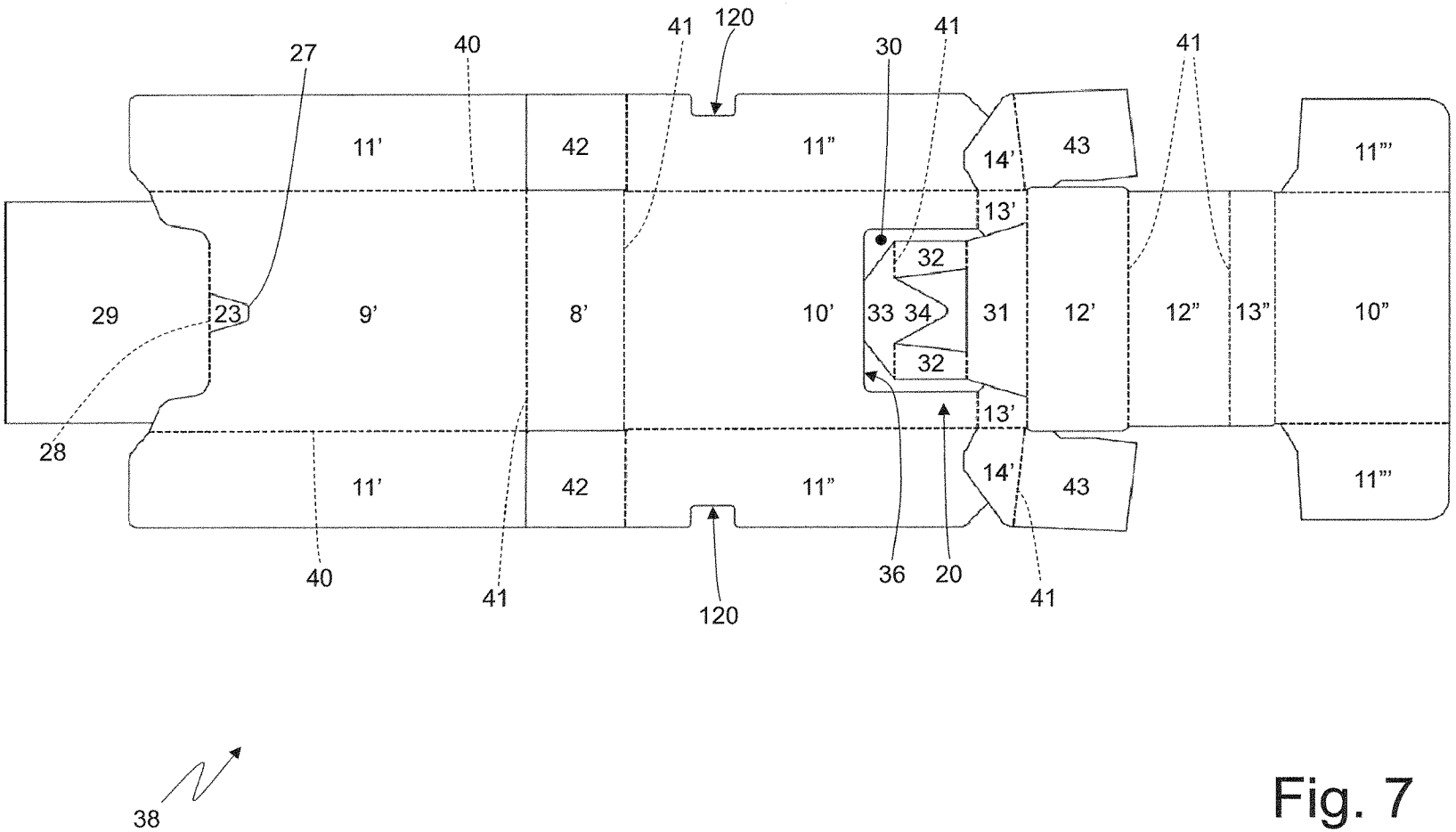
FIG. 7 is a plan view of an inner blank used for producing the inner container of FIG. 4.

As illustrated in FIGS. 4 and 7, the actuating tab 23 is formed by a part of the front wall 9 of the inner container 3 which is separated from the remaining part of the front wall 9 of the inner container 3 by an "U"-shaped through incision 27 and a fold line 28, which joins together the two ends of the "U"-shaped through incision 27. According to a preferred embodiment shown in FIG. 7, the inner container 3 also comprises a lifting tab 29 that is separated from the actuating tab 23 by the fold line 28 (i.e. the lifting tab 29 and the actuating tab 23 are initially arranged side by side and are separated by the fold line 28). The lifting tab 29 is folded about the fold line 28, by 180° to rest on an inner surface of the front wall 9 of the inner container 3. The function of the lifting tab 29 is to determine, due to the force of the spring back effect generated inside the wrapping material, a lifting of the actuating tab 23 with respect to the front wall 9 of the inner container 3: when the rotating tab 29 is rotated about the fold line 28, by 180°, the actuating tab 23 tends (due to the force of the spring back effect generated inside the wrapping material) to accomplish a similar rotation about the fold line 28 and therefore tends to rise with respect to the front wall 9 of the inner container 3 (as shown in FIG. 4).

As shown in FIG. 5, the inner container 3 has a window 30 within which the connecting tab 20 is obtained and the edge of which has, at least in some areas, a certain distance from the edge of the connecting tab 20. The connecting tab 20 comprises a top portion 31, a top edge of which is integral with the lid 6 and that tilts with respect to the rear wall 10 of the inner container 3 to follow the rotation of the lid 6, an intermediate portion 32 that is connected to the top portion 31 along a pre-fold fold line, has a center hole and always remains parallel to the rear wall 10 of the inner container 3, and a bottom portion 33 that is connected to the intermediate portion 32 along a pre-fold fold line and is folded by 180° with respect to the intermediate portion 32 onto the intermediate portion 32 (giving the connecting tab 20 a "U" shape) to form a "hook". The lower portion 33 has a protrusion from the side of the center hole of the intermediate portion 32, and when the lower portion 33 is folded by 180° with respect to the intermediate portion 32, the protrusion 34 comes out of the window 30 and slips partially below the rear wall 10 of the inner container 3. In use, when a bottom edge 35 of the connecting tab 20 (defined in correspondence to the pre-fold fold line between the intermediate portion 32 and the lower portion 33) comes into contact with a bottom edge 36 of the window 30, the sliding movement of the connecting tab 20 with respect to the rear wall 10 of the inner container 3 stops and, consequently, the rotation of the lid 6 stops, in other words, the lower edge 35 of the connecting tab 20 and the lower edge 36 of the window 30 operate as "end-of-stroke", which establishes the maximum opening position of the lid 6 (and therefore the position of maximum extraction of the inner container 3 from the outer container 4).

Figure 8:
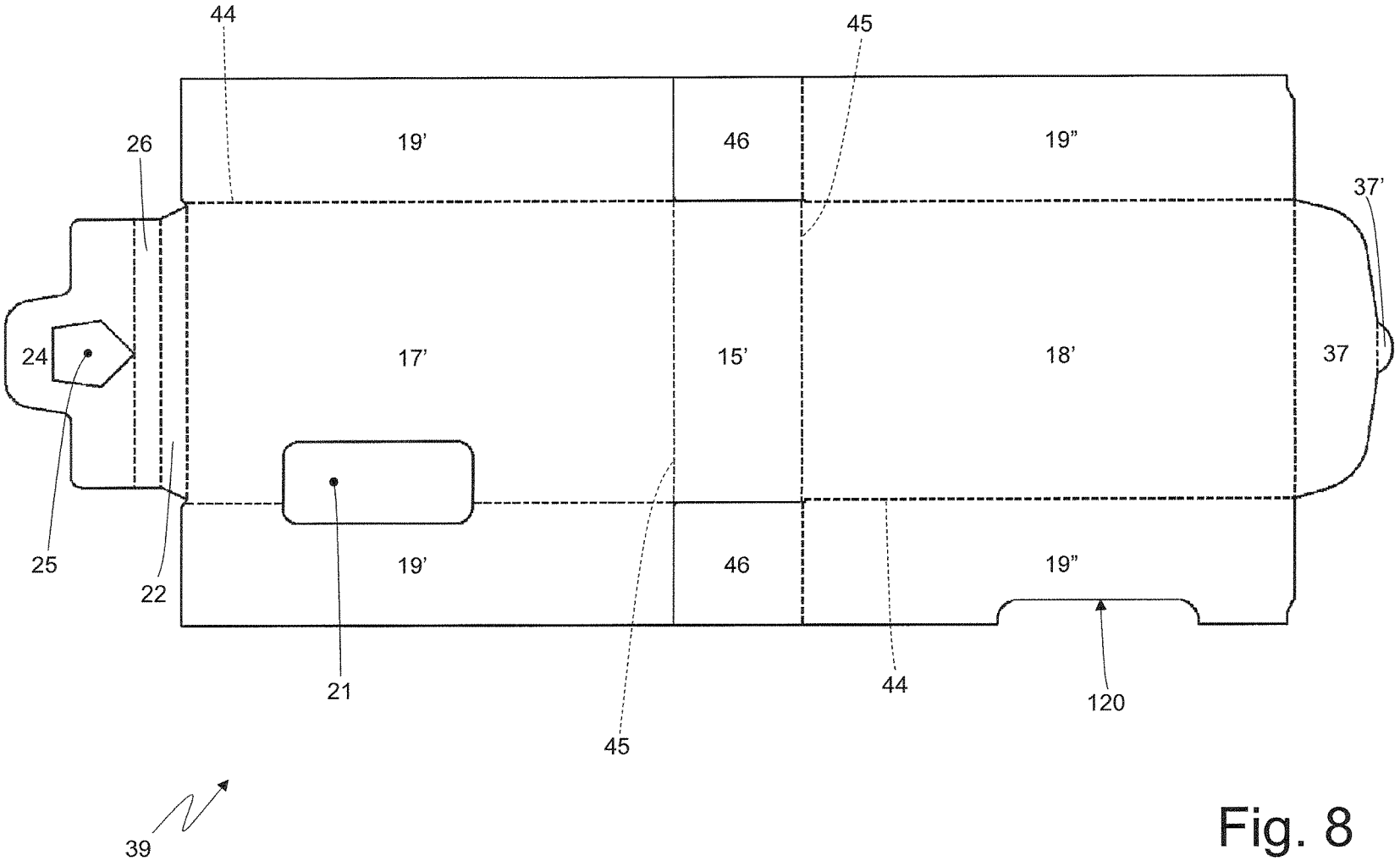
FIG. 8 is a plan view of an outer blank used for producing the outer container of FIG. 6.

As illustrated in FIGS. 6 and 8, the outer container 4 comprises a further connecting tab 37 which is integral with the rear wall 18 of the outer container 4, rises from a top edge of the rear wall 18, and is folded by (about) 180° with respect to the rear wall 18 onto the rear wall 18 itself to have, together with the rear wall 18, a "U" shape. The mechanical connection between the rear wall 13 of the lid 6 and the rear wall 18 of the outer container 4 is made by a coupling between the two connecting tabs 20 and 37: the connecting tab 20 is arranged inside of the "U" defined by the connecting tab 37 and vice versa (i.e. the connecting tab 37 is arranged inside the "U" defined by the connecting tab 20); i.e. a free edge end of the connecting tab 20 rests against the cusp of the "U" formed by the connecting tab 37 and vice versa (i.e. a free end edge of the connecting tab 37 rests against the cusp of the "U" formed by the connecting tab 20). As illustrated in FIG. 8, preferably the connecting tab 37 has an appendix 37' which has the function of improving the mechanical connection between the two connecting tabs 20 and 37; in fact, the appendix 37' is inserted into the hole in the center of the intermediate portion 32 of the connecting tab 20 facilitating the mechanical connection between the two connecting tabs 20 and 37.

When the inner container 3 is in the closed configuration (illustrated in FIG. 1) and then the lid 6 is in the closed position the lower edge 35 of the connecting tab 20 is at a certain distance from the lower edge 36 of the window 30. As the inner container 3 protrudes from the outer container 4, and then as the lid rotates about the hinge 7 from the closed position to the open position, the connecting tab 20 remains integral with the outer container 4 by the effect of the retaining action of the connecting tab 37 and then the connecting tab 20 slides with respect to the inner container 3 within the window 30. By the sliding effect of the connecting tab 20 within the window 30, the lower edge 35 of the connecting tab 20 gradually approaches towards the lower edge 36 of the window 30 until reaching a limit position of maximum opening or wherein the bottom edge 35 of the connecting tab 20 rests on the bottom edge 36 of the window 30. Once reaching said limit or maximum opening position, the connecting tab 20 can no longer slide downwards with respect to the window 30 as the lower edge 35 of the connecting tab 20 is in contact with the lower edge 36 of the window 30; consequently, it is not possible to further extract the inner container 3 from the outer container 4 and therefore it is not possible to further open by rotation the lid 6 about the hinge 7.

In other words, the lower edge 35 of the connecting tab 20, together with the lower edge 36 of the window 30, is an "end-of-stroke" that establishes a maximum opening position (i.e. of maximum extraction of the inner container 3 from the outer container 4 and therefore of maximum rotation of the lid 6 about the hinge 7) further blocking the sliding of the inner container 3 (and therefore the further rotation of the lid 6 about the hinge 7) once reaching the maximum opening position thereof.

The containers 3 and 4 of the package 1 of cigarettes shown in FIGS. 1 to 6 are obtained from corresponding blanks 38 and, respectively, 39 illustrated in FIGS. 7 and 8. Each of the blanks 38 and 39 comprises, among other things, a number of elements, which will be marked, where possible, with accented reference numbers equal to the reference numbers as for the corresponding walls of the respective container 3 and 4.

With reference to FIG. 7, the inner blank 38 has two longitudinal fold lines and a number of transverse fold lines 41, which define, between the two longitudinal fold lines 40, at least one panel 9' which forms the front wall 9 of the inner container 3, a panel 8' which forms the bottom wall 8 of the inner container 3, a panel 10' which forms the rear wall 10 of the inner container 3, a panel 13' which forms the rear wall 13 of the lid 6, a panel 12' which forms the top wall 12 of the lid 6, a reinforcing panel 12" for the panel 12', a reinforcing panel 13" for the panel 13', and a reinforcing panel 10" for the panel 10'. In particular, the panel 12" is glued to the inside of the panel 12', the panel 13" rests on panel 13' and the panel 10" is glued to the inside of the panel 10'.

The panel 9' having two wings 11', which form an outer portion of the lateral walls 11 of the inner container 3, are arranged on opposite sides of the panel 9', and are connected to the panel 9' by longitudinal fold lines 40. The panel 10' has two wings 11", which form an inner portion of the lateral walls 11 of the inner container 3, are arranged on opposite sides of panel 10', and are connected to the panel 10' by the longitudinal fold lines 40. The panel 13' has two wings 14' which form the lateral walls 14 of the lid 6, are arranged on opposite sides of panel 13', and are connected to the panel 13' by the longitudinal fold lines 40. The panel 10" has two reinforcing wings 11'" which are glued to the inside of the corresponding wings 11", are arranged on opposite sides of panel 10", and are connected to panel 10" by the longitudinal fold lines 40.

Each wing 11" has a tab 42 which is connected to the wing 11' by a transverse fold line 41, is folded by 90° with respect to the wing 11", and is glued to an inner surface of the panel 8'. Each wing 14' has a tab 43 that is connected to the wing 14' by a transverse fold line 41, is folded by 90° with respect to wing 14', and is glued to an inner surface of the panel 12'.

With reference to FIG. 8, the outer blank 39 has two longitudinal fold lines 44 and a number of transverse fold lines 45, which define, between the two longitudinal fold lines 44, a panel 17' forming the front wall 17 of the outer container 4, a panel 15' forming the bottom wall 15 of the outer container 4 and a panel 18' forming the rear wall 18 of the outer container 4.

The panel 17' has two wings 19', which form an outer portion of the lateral walls 19 of the outer container 4, are arranged on opposite sides of the panel 17', and are connected to the panel 17' by longitudinal fold lines 44. The panel 18' has two wings 19", which form an inner portion of the lateral walls 19 of the outer container 4, are arranged on opposite sides of the panel 18', and are connected to the panel 18' by longitudinal fold lines 44.

Each wing 19" has a tab 46 which is connected to the wing 19' by a transverse fold line 45, is folded by 90° with respect to the wing 19", and is glued to an inner surface of the panel 15'.

Figure 9:
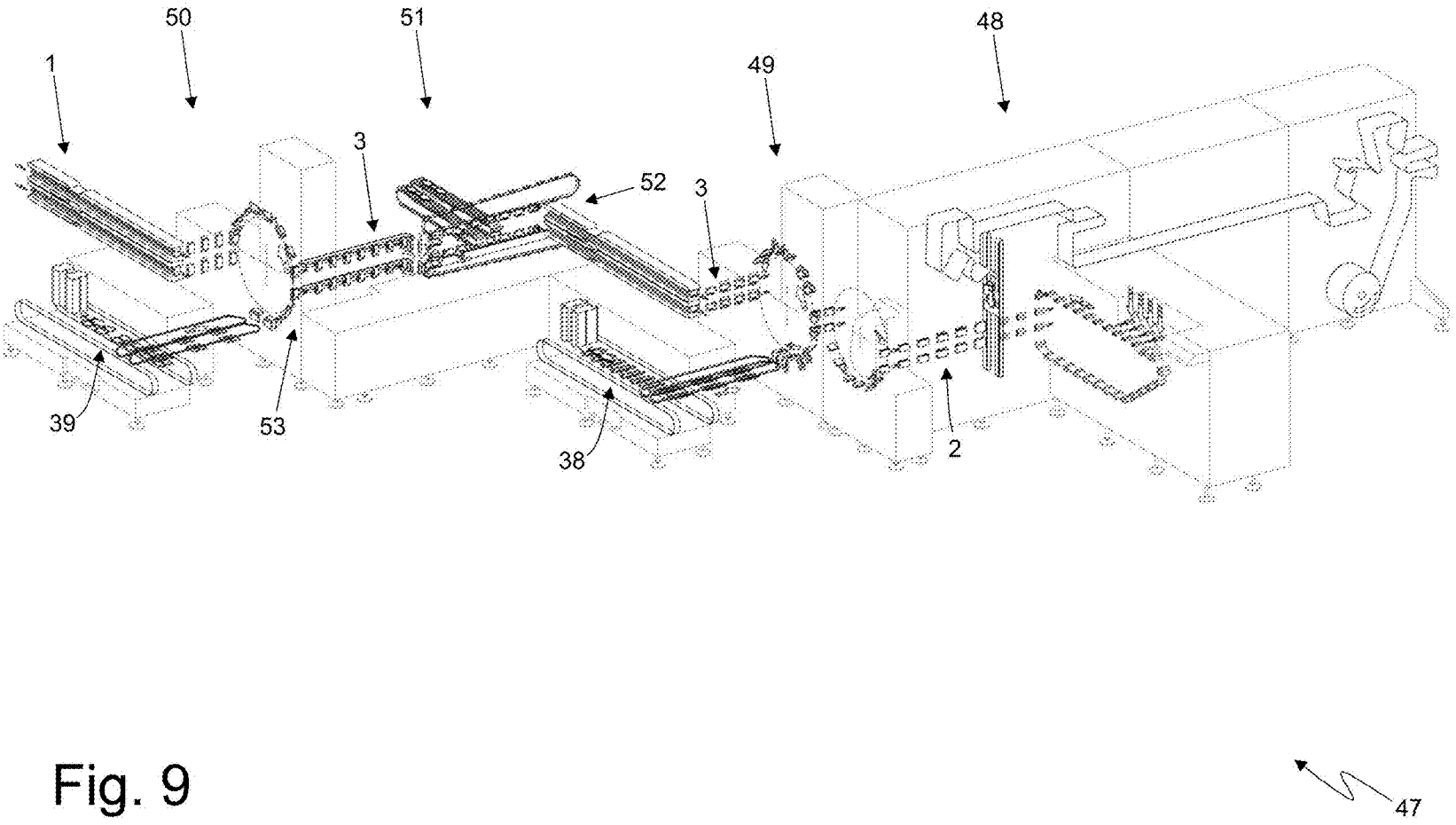
FIG. 9 is a schematic perspective view of a packing machine that produces the package of cigarettes of FIG. 1 and is made according to the present invention.

In FIG. 9 a cigarette packing machine 47 is illustrated that produces the packages 1 of cigarettes of the type described above and illustrated in FIGS. 1 to 3.

The packing machine 47 comprises a packing unit 48 that produces the wrapped groups 2 of cigarettes, a subsequent packing unit 49 that produces the inner containers 3 by folding the blanks 38 about corresponding wrapped groups 2 of cigarettes received by the packing unit 48, a packing unit 50 that produces the outer containers 4 by folding the blanks 39 about corresponding inner containers 3 received by the packing unit 49, and a transfer unit 51 which receives in input the inner containers 3 from the packing unit 49 in correspondence to an input station 52 and feeds in output the inner containers 3 to the packing unit 50 in correspondence to an output station 53.

Figure 10:
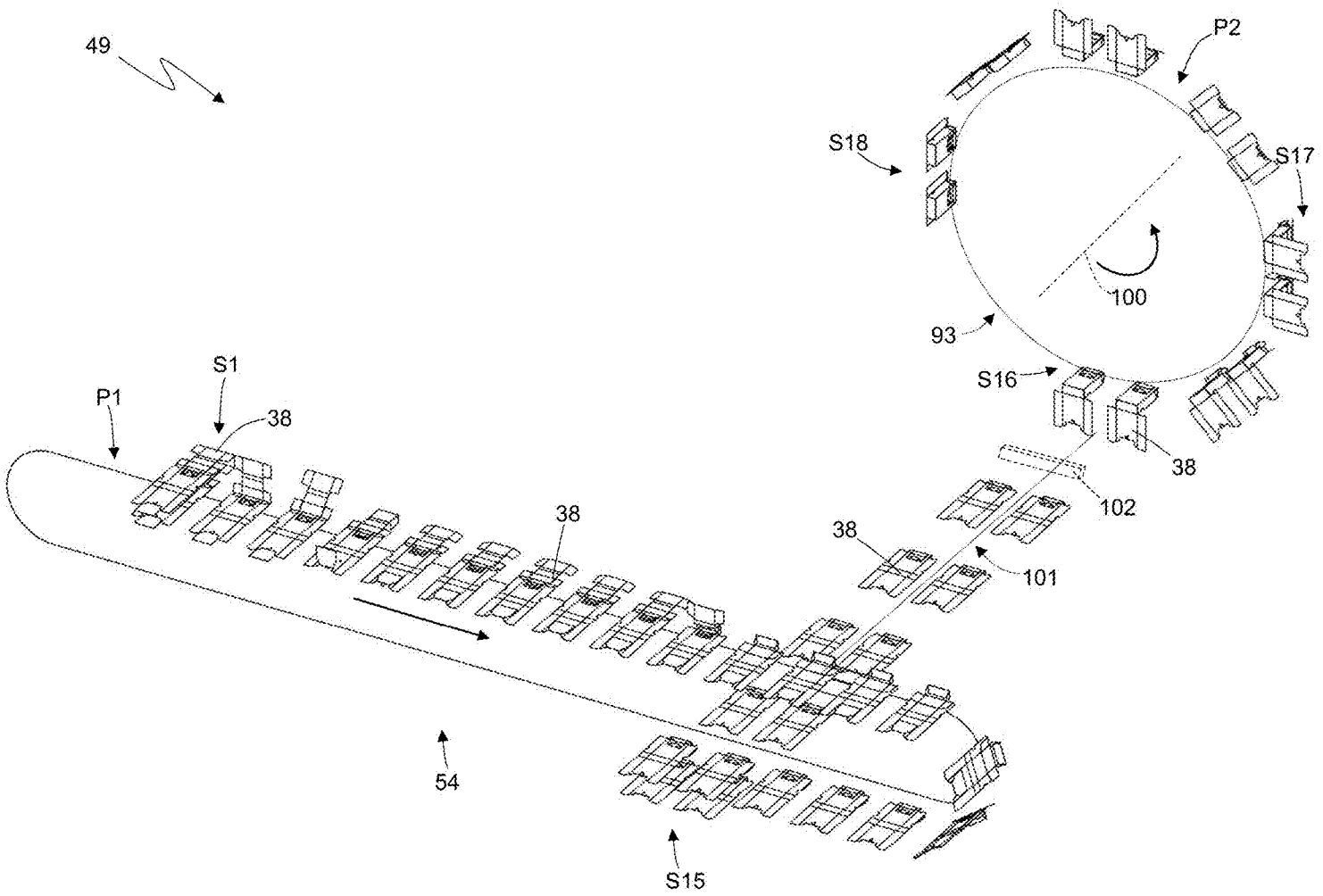
FIG. 10 is a schematic perspective view of a first packing unit of the packing machine of FIG. 9.
Figure 11:
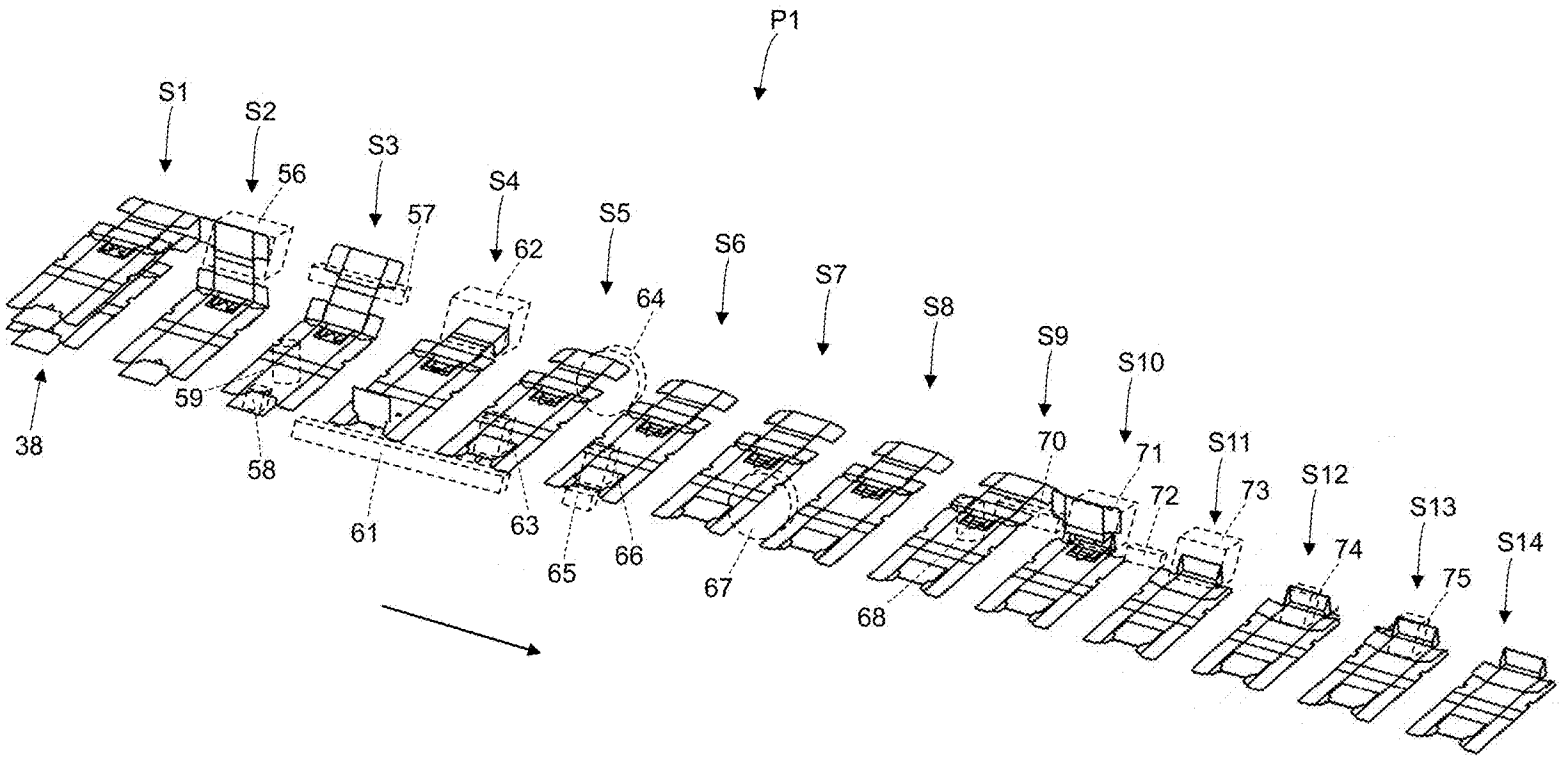
FIG. 11 is a schematic perspective view of a first packing conveyor of the first packing unit of FIG. 10.
Figure 12:
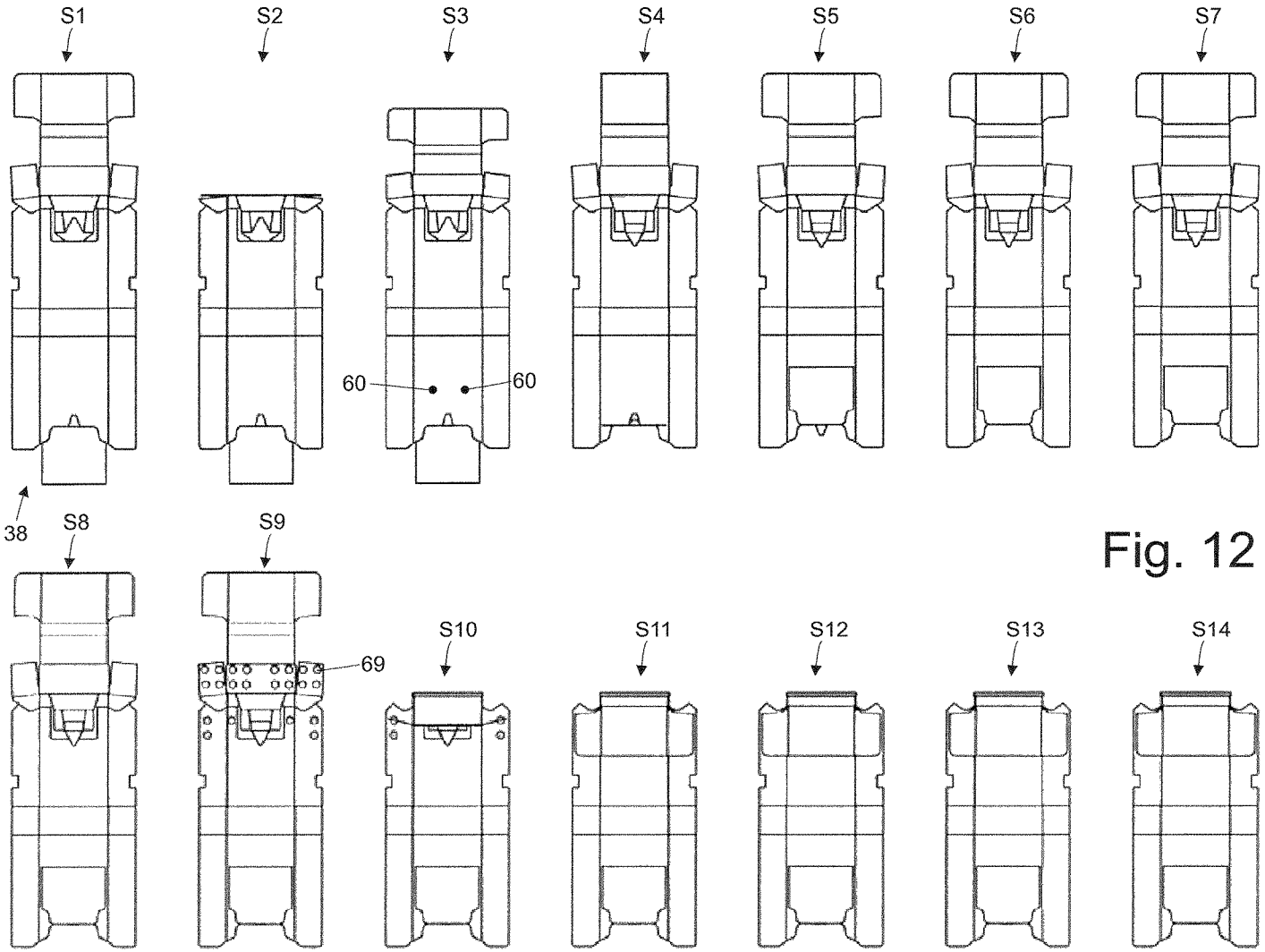
FIG. 12 is a plan view of a sequence of preliminary folding of the inner blank of FIG. 7 operated in the first packing conveyor of FIG. 11.

As illustrated in FIG. 10, the packing unit. 49 comprises a packing conveyor 54 which is provided with a number of packing pockets 55 (shown in FIG. 18), each of which is adapted to house an inner blank 38 to feed the inner blank 38 by steps (i.e. with intermittent motion composed by a succession of motion steps intercalated with a corresponding succession of stopping steps) along a packing path P1 that extends between an input station S1 and an output station S15 through a succession of work stations from S2 to S14 (illustrated in FIGS. 11 and 12).

In correspondence to the input station S1, a hopper (not shown) is provided, which houses a stack of inner blanks 38 and cyclically feeds the inner blanks 38 from a bottom outlet towards the packing pockets 55 of the packing conveyor 54; in particular, each inner blank 38 arranged in correspondence to the bottom outlet of the hopper is picked up by a suction gripping head that moves vertically and is supported to an underlying packing pocket 55 of the packing conveyor 54 that stops and waits in the input station S1 in alignment with the bottom outlet.

It is important to note that the packing conveyor 54 feeds each inner blank 38 along the packing path P1 always transversely, i.e. always with the transverse fold lines 41 parallel to the feed direction; in other words, the packing conveyor 54 does not ever vary the orientation of each inner blank 38 with respect to the feed direction, and then in all the points of the packing path P1 each inner blank 38 has always its transverse fold lines 41 parallel to the feed direction (and thus its own longitudinal fold lines 40 perpendicular to the feed direction). Always maintaining a constant orientation of each inner blank 38 along the packing path P1 allows to simplify both the folding operations, and the structure of the packing conveyor 54.

Figure 18:
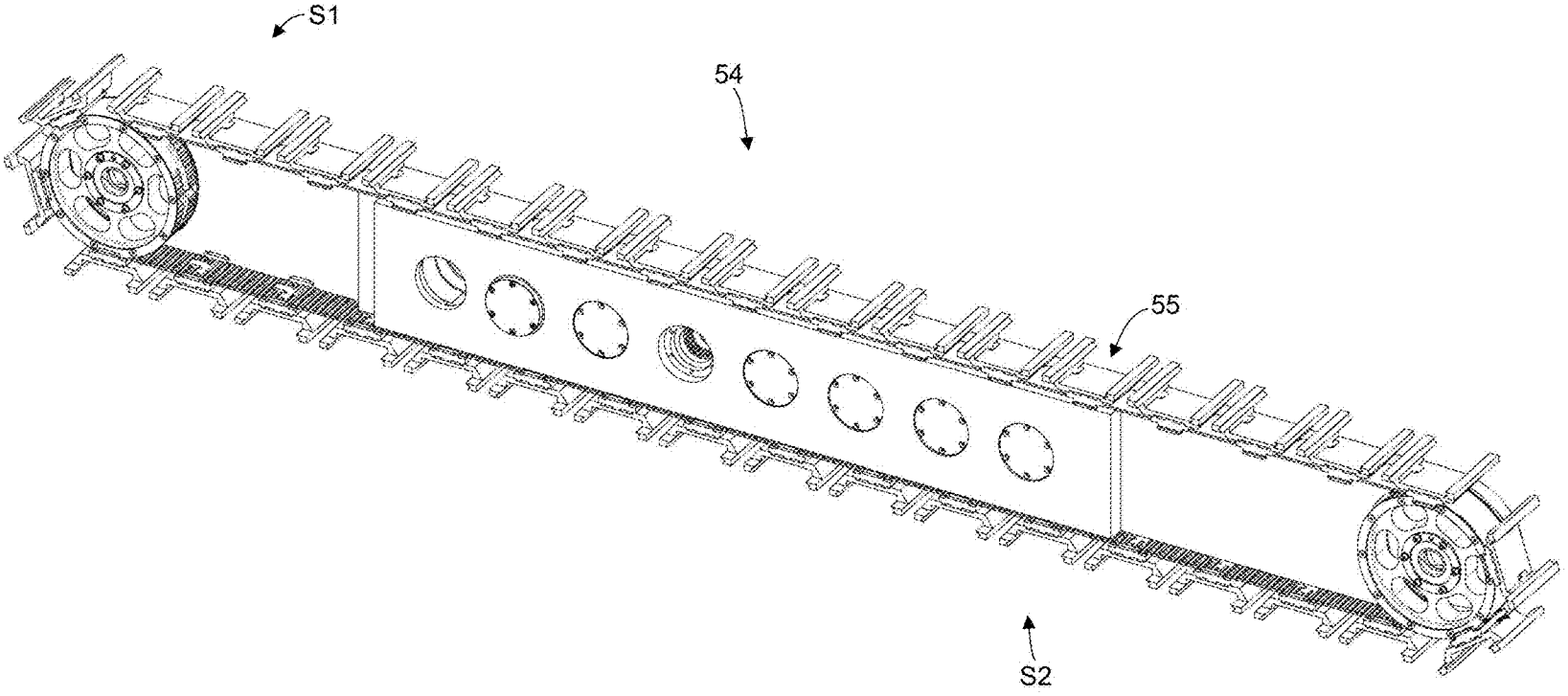
FIG. 18 is a schematic and perspective view of a belt conveyor of the first packing unit of FIG. 10.

According to a preferred embodiment shown in FIG. 18, the packing conveyor 54 is constituted by a conveyor belt that is wrapped about two end pulleys and supports a number of packing pockets 55; accordingly, the packing path P1 has an "U" shape and extends between the input station S1 arranged along a straight initial portion of the packing path P1 and the output station S15 arranged along a straight end portion of the packing path P1 which is connected to the straight initial portion by way of an intermediate semicircular portion.

As illustrated in FIG. 11, in the work station S2 a folding device 56 is provided having movable parts (i.e. parts that move to perform the folding operation while the inner blank 38 is stopped waiting in the work station S2); the folding device 56 simultaneously folds by 90° the panel 12', with respect to the panel 13' and the tabs 43 with respect to the wings 14' about the same transverse fold line 41 giving the inner blank 38 an "L" shape. In the work station S3 a folding device 57 is provided having fixed folding profiles (i.e. folding helixes that are devoid of movable parts and perform the folding operation while the inner blank 38 moves in the packing path P1 and thus exploiting the feeding movement of the inner blank 38); the folding device 57 simultaneously folds by 90° the panel 12', with respect to the panel 13' and the tabs 43 with respect to the wings 14' about the same transverse fold line 41 and in the opposite direction to the similar fold made by the folding device 56 in the work station S2 giving again the inner blank 38 a flat shape. The two folding devices 56 and 57 perform two opposite folding operations (i.e. that cancel each other) having a flex function (i.e. weakening in order to considerably reduce the residual spring back force) the inner blank 38 along the corresponding transverse fold line 41. Therefore, the function of the two folding devices 56 and 57 is not to perform an actual folding of the inner blank 38, but rather to prepare the inner blank 38 for the subsequent folding operations (described below).

The above-described flexing of the inner blank 38 along the transverse fold line 41 which divides the panel 12' with respect to the panel 13' and the tabs 43 from the wings 14' is very useful to allow the proper formation of the lid 6 described in the following; i.e., without this flexing of the inner blank 38 the formation of the lid 6 described in the following can become problematic, and then determine a significant increase of defective inner containers 3 (due to a malformation of the lid 6) that must be discarded.

Moreover, in the work station S3 a folding device 58 is provided having movable parts (i.e. parts that move to perform the folding operation while the inner blank 38 is stopped waiting in the work station S3); the folding device 58 folds by 90°, the actuating tab 23 with respect to panel 9' and about the fold line 28, with the function of flexing the actuating tab 23 along the fold line 28.

Finally, in the work station S3 a gumming device 59 (typically provided with nozzles that spray gumming glue) which deposits glue points 60 (illustrated in FIG. 12) on the panel 9' is provided.

Between the work station S3 and the work station S5 a folding device 61 is provided having fixed folding profiles (i.e. folding helixes that are devoid of moving parts and perform the folding operation while the inner blank 38 moves in the packing path P1 and thus exploiting the feeding movement of the inner blank 38); the folding device 61 folds by 180° the lifting tab 29 with respect to the panel 9' and about the fold line 28. In particular, the folding device 61 folds by 90° the lifting tab 29 with respect to the panel 9' and about the fold line 28 between the work station S3 and work station S4 (i.e. in the work station S4 the lifting tab 29 is fold by 90° with respect to the panel 9'), and thereafter, the folding device 61 folds by further 90° (for a total of 180°) the lifting tab 29 with respect to the panel 9' and about the fold line 28 between the work station S4 and the work station S5 (i.e. in the work station S5 the lifting tab 29 is folded by 180° with respect to the panel 9' and onto the panel 9' itself to which is glued by the effect of the presence of glue 60).

In the work station S4 a folding device 62 is provided having movable parts (i.e. parts that move to perform the folding operation while the inner blank 38 is stopped waiting in the work station S4), the folding device 62 simultaneously folds by 90° the reinforcing wings 11''' with respect to the panel 10" and about corresponding longitudinal fold lines 40 and folds by 180° the bottom portion 33 of the tab 20 with respect to the intermediate connecting portion 32, about a transverse fold line 41, and onto the intermediate portion 32 itself. It is important to note that downstream from the folding device 62 the reinforcing wings 11''' are left free to spring back to their original position; in practice the reinforcing wings 11''' not exactly return to the initial position perfectly coplanar with the panel 10", but assume a slightly inclined position with respect to the panel 10" (as shown in FIG. 11).

In the work station S5 a presser device 63 is provided having movable parts (i.e. parts that move to perform the pressing operation while the inner blank 38 is stopped waiting in the work station S5) that locally flattens the inner blank 38 by pressing on the lifting tab 29 to press the folding of the tab 29 again onto the lifting panel 9'.

Between the work station S5 and the work station S6 a rotating presser device 64 is arranged (i.e., consisting of a rotatable drum that by rotating "rolls" an outer surface on the inner blank 38 while the inner blank 38 moves in the packing path P1) that locally flattens the inner blank 38 by pressing on the bottom portion 33 of the connecting tab 20 to press the folding of the bottom portion 33 again onto the intermediate portion 32.

In the work station S6 a folding device 65 is provided having movable parts (i.e. parts that move to perform the folding operation while the inner blank 38 is stopped waiting in the work station S6), the folding device 65 folds by 90° the actuating tab 23 with respect to panel 9', about the fold line 28 and onto the panel 9' itself.

In the work station S6 a presser device 66 is provided having movable parts (i.e. parts that move to perform the pressing operation while the inner blank 38 is stopped waiting in the work station S6) that locally flattens the inner blank 38 by pressing on lifting tab 29 to press both the folding of the lifting tab 29 again onto an inner wall of the panel 9', and the folding of the actuating tab 23 onto an outer wall of the panel 9'.

Between the work station S7 and the work station S8 a rotating presser device 67 is arranged (i.e., consisting of a rotatable drum that by rotating "rolls" an outer surface on the inner blank 38 while the inner blank 38 moves in the packing path P1) that locally flattens the inner blank 38 by pressing on the lifting tab 29 and on the actuating tab 23 to press the folding of the lifting tab 29 and of the actuating tab 23 again onto the panel 9'.

In the work station S9 a gumming device 68 is provided (typically provided with nozzles that spray gumming glue) which deposits glue points 69 (illustrated in FIG. 12) on the panel 12', on the tabs 43 and on the wings 11".

Folding means fold the inner blank 38 so as to form a hinged lid 6. The aforementioned folding means overlap at least one reinforcing panel at least on the first panel 10' during the forming of the lid 6. In particular, in the embodiment provided for the inner blank 38, the first folding means overlap at least the reinforcing panel 10" at least on the first panel 10' during the forming of the lid 6. Furthermore, said folding means form the lid 6 leaving flat the other parts of the blank 38 different therefrom.

Said folding means preferably comprise a number of folding devices 70, 71, 72, 73, as hereinafter described in greater detail.

Between the work station S9 and the work station S10 a folding device 70 is arranged which is provided with fixed folding profiles (i.e. folding helixes that are devoid of moving parts and perform the folding operation while the inner blank 38 moves in the packing path P1 and thus exploiting the feeding movement of the inner blank 38); the folding device 70 folds by 90°, the panel 12" with respect to panel 12' and about a corresponding transverse fold line 41.

In the work station S10 a folding device 71 is provided having movable parts (i.e. parts that move to perform the pressing operation while the inner blank 38 is stopped waiting in the work station S10). The folding device 71 initially folds the tabs 43 by 90° with respect to the wings 14' and about corresponding transverse fold lines 41, and subsequently at the same time (i.e. together) folds the wings 14' by 90° with respect to the panel 13' and about corresponding longitudinal fold lines 40, folds the panel 12' by 90° with respect to the panel 13' and about a corresponding transverse fold line 41 (in this way the tabs 43 rest on the panel 12' to which are glued by the effect of the presence of the glue 69), fold the panel 12" by 90° with respect to the panel 12' and about a corresponding transverse fold line 41, and fold the panel 13" by 90° with respect to panel 12" and about a corresponding transverse fold line 41.

Between the work station S10 and the work station S11 a folding device 72 is arranged which, is provided with fixed folding profiles (i.e. folding helixes that are devoid of movable parts and perform the folding operation while the inner blank 38 moves in the packing path P1 and thus exploiting the feeding movement of the inner blank 38), the folding device 72 folds the panel 13" by 90°, with respect to panel 12" about a corresponding transverse fold line 41 and in the opposite direction to the similar fold made by the folding device 71 in the work station 10. The two folding devices 71 and 72 perform two opposite folding operations (i.e. that cancel each other) between the two panels 12" and 13" having the function of flexing (or weakening to considerably reduce the residual spring back force) the inner blank 38 along the corresponding transverse fold line 41.

In the work station S11 a folding device 73 is provided having movable parts (i.e. parts that move to perform the folding operation while the inner blank 38 is stopped waiting in the work station S11), the folding device 73 simultaneously (i.e. together) fold the panel 12" by 90°, with respect to panel 12' and about a corresponding transverse fold line 41 (in this way the panel 12" rests to the panel 12' to which is glued due to the presence of the glue 69) and folds the panel 13" by 96° with respect to panel 12" and about a corresponding transverse-fold line 41 (in this way the panel 13" rests to the panel 13', the panel 10" rests on the panel 10' to which is glued due to the presence of the glue 69 and the wings 11'" overlap with the wings 11" without resting; in a subsequent work station the wings 11'" will be glued to the wings 11" due to the presence of the glue 69).

In the work station S12 a presser device 74 is provided having movable parts (i.e. parts that move to perform the folding operation while the inner blank 38 is stopped waiting in the work station S12) that locally flattens the inner blank 38 by pressing on the panel 10" to press the folding of the panel 10" again onto the panel 10'.

In the work station S13 a presser device 75 is provided, identical to the previous presser device 74, which is provided with movable parts (i.e. parts that move to perform the folding operation while the inner blank 38 is stopped waiting in the work station S13) that locally flattens the inner blank 38 by pressing on the panel 10" to press the folding of the panel 10" again onto the panel 10'.

Figure 13:
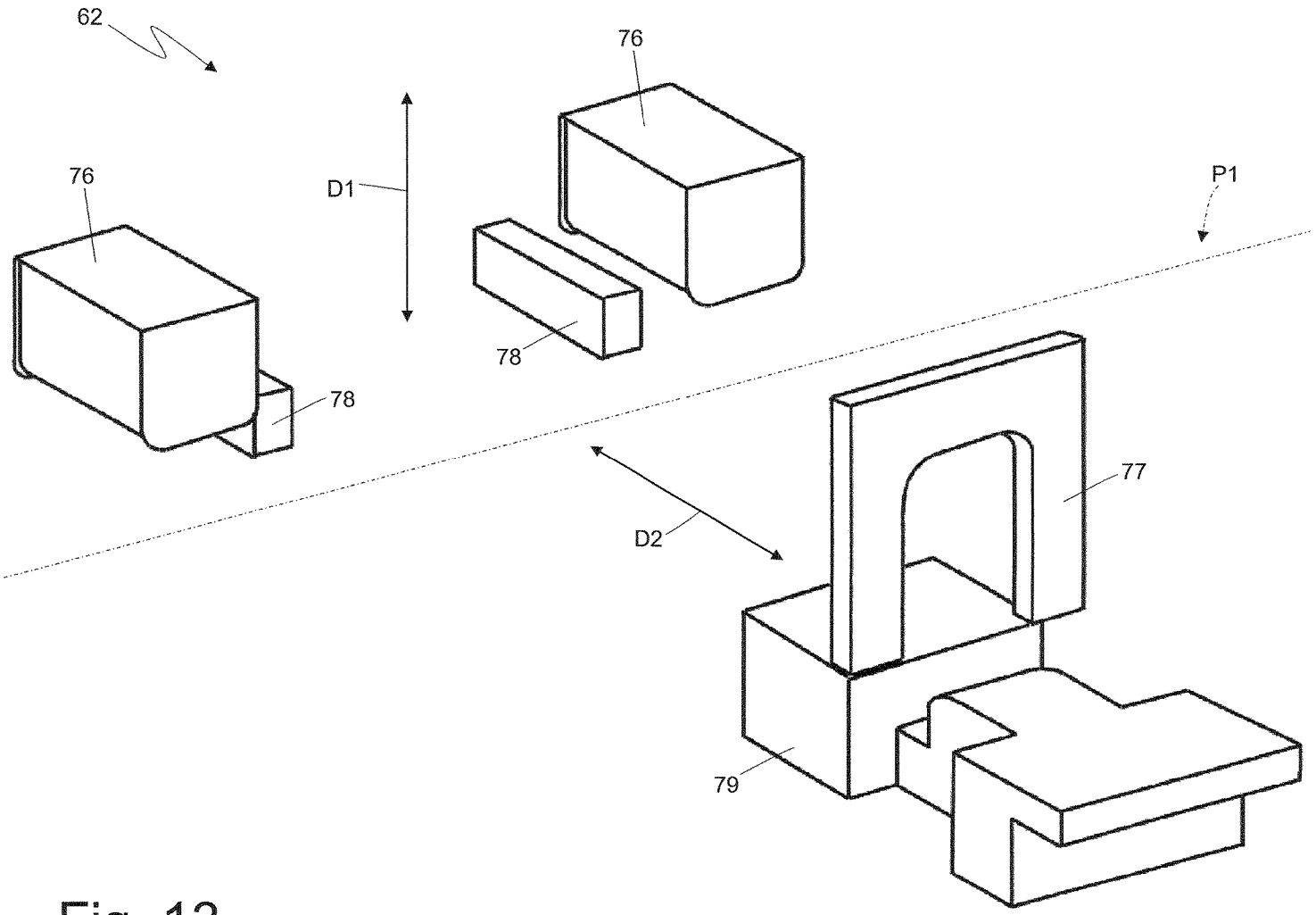
FIGS. 13 to 16 are four schematic and perspective views of four corresponding folding devices associated with the first packing conveyor.

As illustrated in FIG. 13, the folding device 62 comprises two lateral folding bodies 76 of parallelepiped shape and a center folding body 77 "U"-shaped which are mounted on the same carriage to move cyclically along a direction D1 of vertical work that is perpendicular to the packing path P1. Furthermore, the folding device 62 comprises two lateral contrast bodies 78 of parallelepiped shape and a center contrast body 79 that are mounted on the same carriage to move cyclically along a horizontal work direction D2 that is perpendicular to both the packing path P1, and the vertical work direction D1. In use, the two lateral folding bodies 76 move from top to bottom along the vertical work direction D1 to fold the reinforcing wings 11'" by 90° with respect to panel 10" and about corresponding longitudinal fold lines 40; in this step the two contrast bodies 78 are arranged below the panel 10" and from opposite sides of the panel 10" close to the longitudinal fold lines 40 to provide a contrast for the two lateral folding bodies 76. Simultaneously with the action of the two lateral folding bodies 76, the folding body 77 moves downwards along the vertical work direction D1 to fold the bottom portion 33 of the connecting tab 20 by 90°, with respect to the intermediate portion 32 and about a transverse fold line 41; in this step, the center contrast body 79 is arranged below the panel 10' in correspondence to the connecting tab 20 to provide a contrast for the folding body 77. After the folding bodies 76 and 77 have moved downwards along the vertical work direction D1, the contrast bodies 78 and 79 move together along the horizontal work direction D2: the two, contrast bodies 78 move along the horizontal work direction D2 to move from the trajectory of the reinforcing wings 11'" and thus allow the subsequent feeding of the inner blank 38 along the packing path P1, while the center contrast body 79 moves in the horizontal work direction D2 to fold by further 90° (i.e., for a total of 180°) the bottom portion 33 of the connecting tab 20 with respect to the intermediate portion 32 and about a transverse fold line 41 so as to fold the portion 33 onto the intermediate bottom portion 32 itself.

Figure 14:
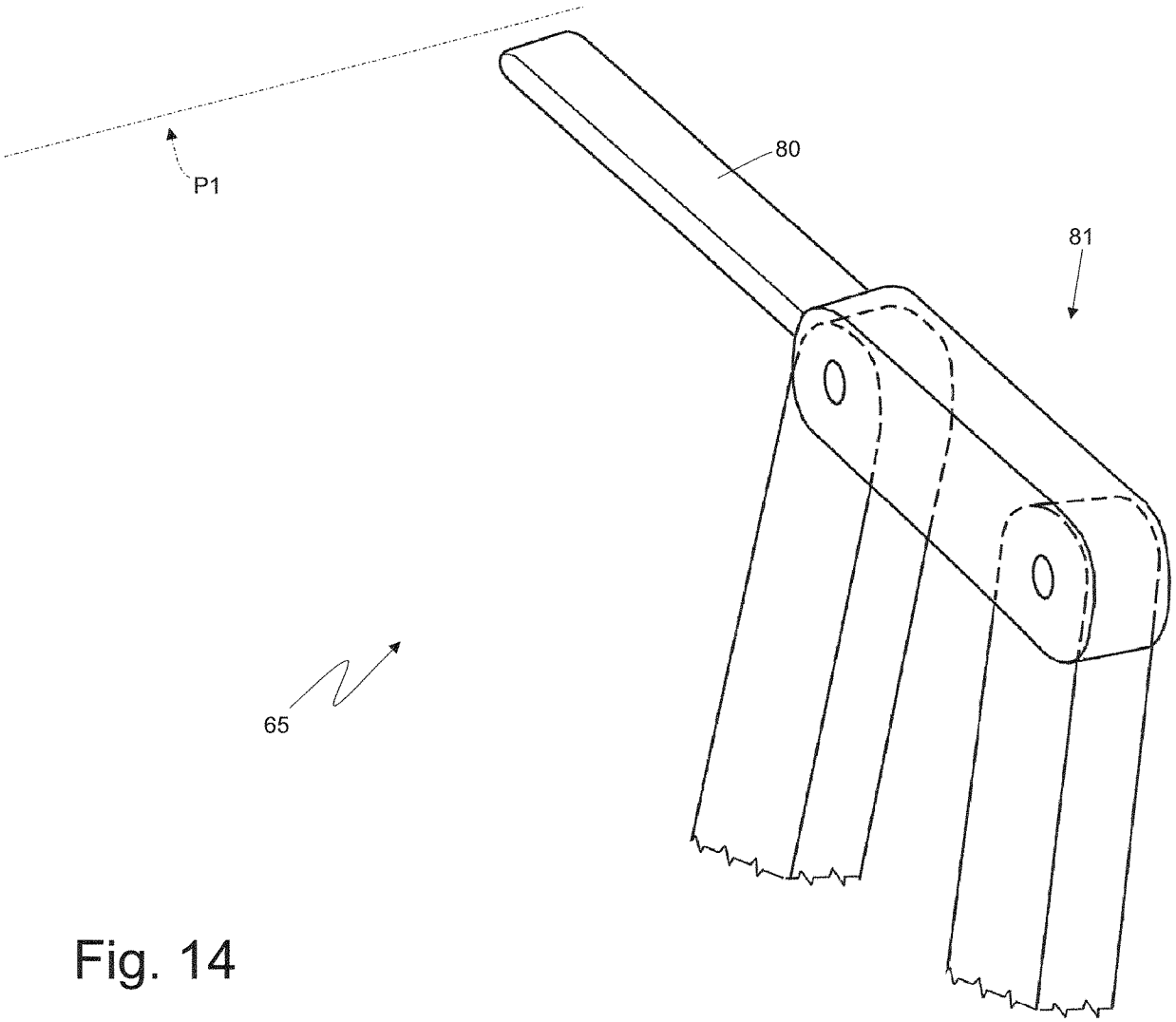

As illustrated in FIG. 14, the folding device 65 comprises a folding body 80 which performs a folding roto-translation movement perpendicular to the packing path P1 and is supported by an articulated quadrilateral 81.

Figure 15:
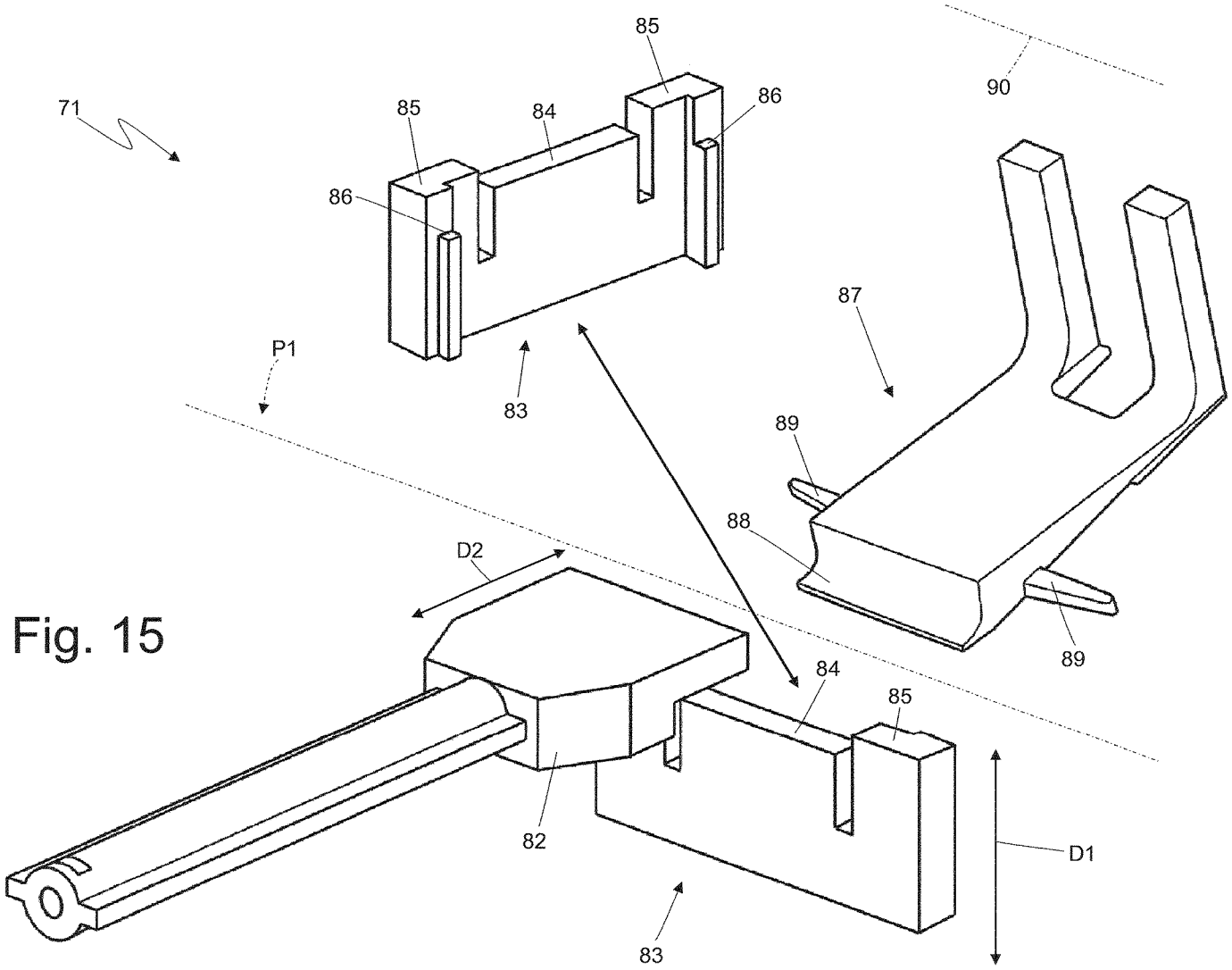

As illustrated in FIG. 15, the folding device 71 comprises a folding body 82 that has in section a "L" shape and is movable in the horizontal work direction D2 (which is perpendicular to the packing path P1). Furthermore, the folding device 71 comprises a folding body 83 which has a center folding member 84, two top lateral members 85 arranged on opposite sides of the center member 84, and two bottom lateral members 86 also arranged on opposite sides of the center member 84. The folding device 71 is movable in the vertical work direction D1 (which is perpendicular to both the packing path P1, and the horizontal work direction D2); in addition, the center member 84, the two top lateral members 85, and the two bottom lateral members 86 are arranged in different positions vertically (i.e. along the work direction D1) to execute in succession respective folding of the inner blank 38 while the folding body 83 moves vertically with a continuous movement (i.e. along the work direction D1). Finally, the folding device 71 comprises a contrast body 87 which has a "hoe"-shaped center member 88 and two lateral appendixes 89 arranged on opposite sides of the center member 88 and is mounted to rotate about an axis of rotation 90 parallel to the packing path P1.

In use, when the inner blank 38 stops at the work station S10, the contrast body 87 rotates about the axis of rotation 90 to arrange the two lateral appendixes 89 above the wings 14' and close to the tabs 43, to form a contrast for the top lateral members 85 of the folding body 83, and then the folding body moves from the bottom upwards in the vertical work direction D1 so that the two top lateral members 85 fold the tabs 43 by 90°, with respect to the wings 14' and about corresponding transverse fold lines 41. Subsequently, the contrast body 87 rotates in reverse about the axis of rotation 90 to remove the two appendixes 89 from the wings 14' and at the same time to rest the center member 88 on the panel 13', to form a contrast to the center member 84 of the folding body 83, and then the folding body 83 moves further upwards along the vertical work direction D1 so that two bottom lateral members 86 fold the wings 14' by 90° with respect to the panel 13' and about corresponding longitudinal fold lines 40 and at the same time the center member 84 fold the panel 12' by 90°, with respect to the panel 13' and about a corresponding transverse fold line 41 (in this way the tabs 43 rest on the panel 12' to which are glued by the effect of the presence of glue 69). Finally, the folding body 82 moves in the horizontal work direction D2 and towards the contrast body 87 to fold the panel 12" by 90°, and onto the contrast body 87 with respect to the panel 12' and to fold the panel 13" by 90°, with respect to the panel 12" and about a corresponding transverse fold line 41.

Figure 16:
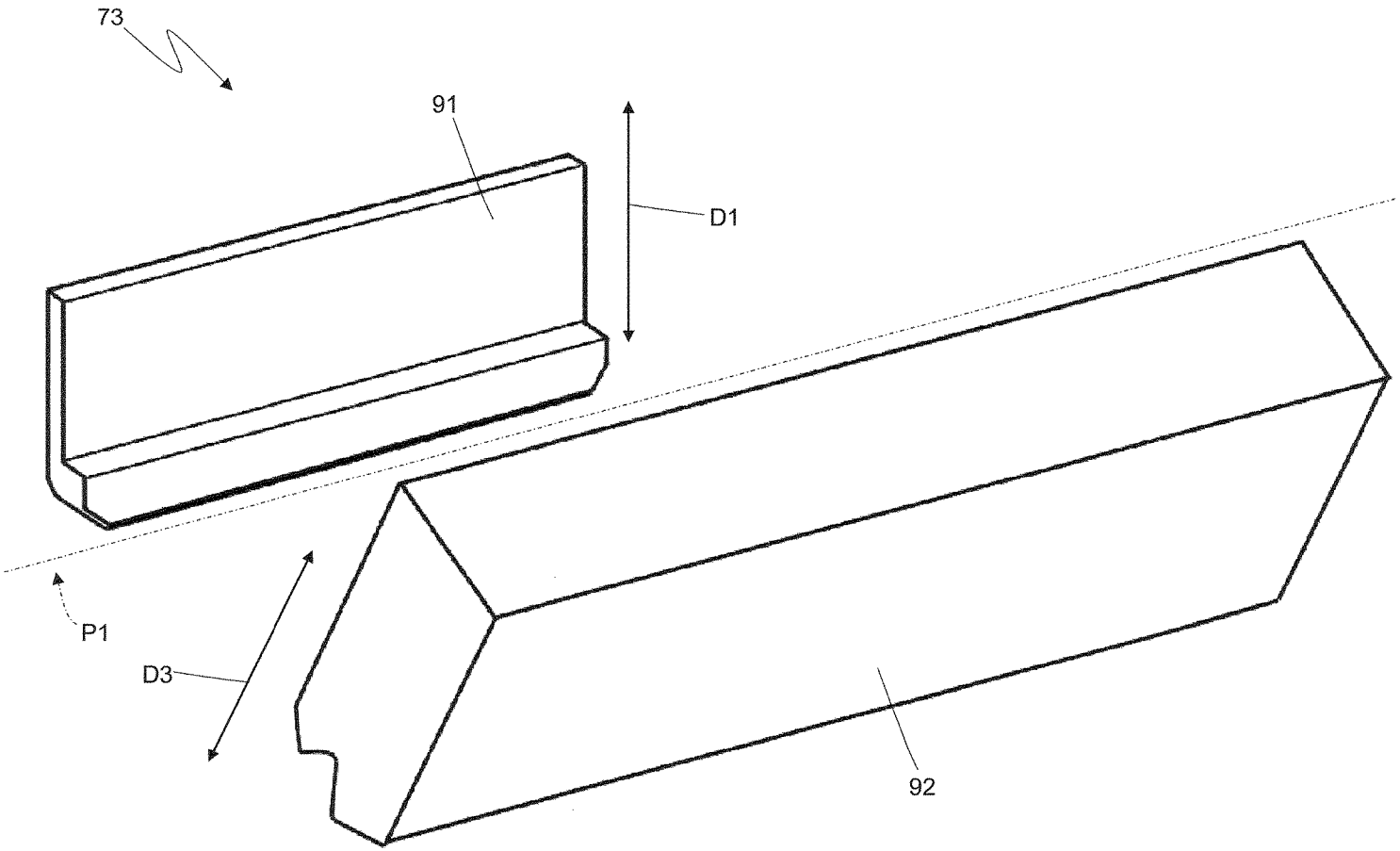

As illustrated in FIG. 16, the folding device 73 comprises a folding body 91 which is movable in the vertical work direction D1 (which is perpendicular to the packing path P1), and an aligner body 92 which is movable in a tilted work direction D3 (which is not parallel to the vertical work direction D1, nor to the horizontal work direction D2, nor to the packing path P1). In use, when the inner blank 38 stops at the work station S11, the folding body 91 moves downwards along the vertical work direction D1 to fold the panel 12" by 90°, with respect to the panel 12' and about a corresponding transverse fold line 41 (in this way the panel 12" rests on the panel 12' to which is glued due to the presence of glue 69) and to simultaneously fold the panel 13" by 90°, with respect to the panel 12" and about a corresponding transverse fold line 41 (in this way the panel 13" rests on the panel 13', the panel 10" rests on the panel 10' to which is glued due to the presence of glue 69, and the wings 11'" overlap the wings 11" without resting; in a subsequent work station the wings 11'" will be glued to the wings 11" due to the presence of glue 69). Subsequently, the aligner body 92 moves downwards in the tilted work direction D3 to hold down the end edge of the panel 10".

Figure 17:
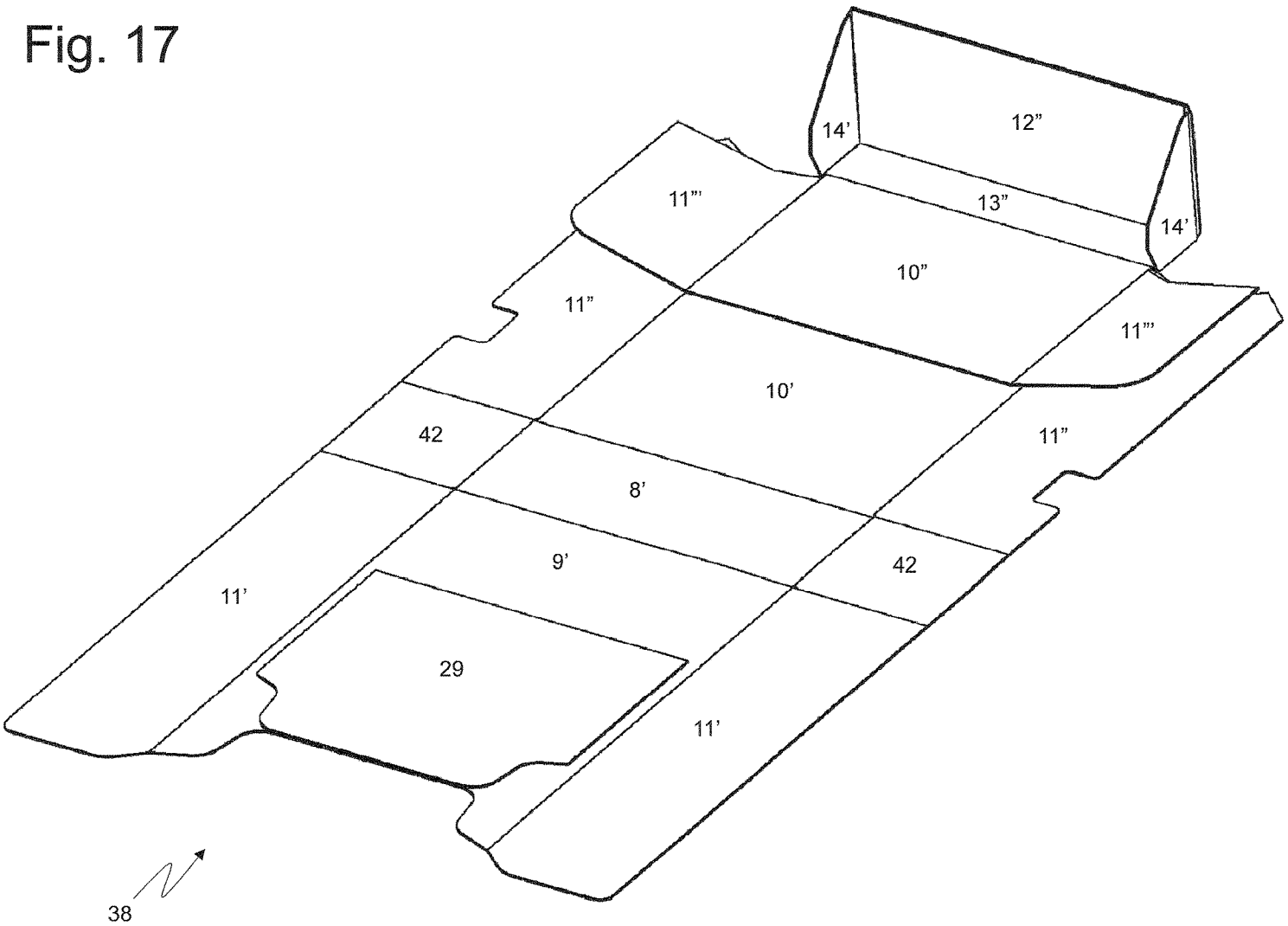
FIG. 17 is an enlarged-scale view of a detail of FIG. 11.

According to a preferred embodiment, better illustrated in FIG. 17, when the panel 12" is folded by 90° with respect to panel 12' and simultaneously the panel 13" is folded by 90°, with respect to panel 12" of the folding body 91, the wings 11'" are maintained slightly raised with respect to the underlying wings 11" (while the panel 10" completely rests on the underlying panel 10'), in particular, the action of the aligner body 92 keeps the wings 11'" slightly raised with respect to the underlying wings 11" by resting and pressing on the end edge of the panel 10". In this way, during the subsequent feeding of the inner blank 38 in the packing path P1, downstream from work station S11 and towards the work station S12, while the folding body 91 moves from the bottom upwards in the vertical work direction D1, the aligner body 92 can remain lowered and hold down the end edge of the panel 10", maintaining the panels 10" and 13" in the correct position facing the underlying corresponding panels 10' and 13', and keeping the panel 12" pressed onto the underlying panel 12'.

The fact that the folding device 62 folds the reinforcing wings 11'" by 90°, and subsequently downstream from the folding device 62 the reinforcing wings 11'" are set free facilitates the fact that the reinforcing wings 11'" remain slightly raised with respect to the underlying wings 11".

In a work station arranged downstream from the packing path P1, the wings 11'" are pressed onto the wings 11" to complete the gluing between the wings 11'" and the wings 11" due to the presence of glue 69, simultaneously with the folding of the wings 11" by 90°, with respect to panel 10' and about corresponding longitudinal fold lines 40. In other words, the wings 11'" are glued to the wings 11" when the wings 11" are in perpendicular position to the panel 10' and this cannot happen in a work station of the packing path P1, since along the packing path P1 the wings 11" always remain coplanar with the panel 10'.

As illustrated in FIG. 10, the packing unit 49 comprises a packing conveyor 93 which is provided with a number of packing pockets 94 (illustrated schematically in FIG. 19), each of which is adapted to house an inner blank 38 and the corresponding wrapped group 2 of cigarettes for feeding the inner blank 38 and the wrapped group 2 of cigarettes along a packing path P2 that extends between an input station S16 and an output station S18.

At the input station S16, an inner blank 38 partially pre-folded and coming from the packing conveyor 54 is fed into a packing pocket 94 causing a further folding of the inner blank itself. In correspondence to a feed station S17 arranged between the input station S16 and the output station S18, a wrapped group 2 of cigarettes is fed inside a packing pocket to be coupled to the previously fed inner blank 38; in particular, a rear wall of the wrapped group 2 of cigarettes rests on the panel 10' of the inner blank 38. At the output station S18, the inner container 3 (formed by folding the inner blank 38 about the wrapped group 2 of cigarettes) is extracted from the packing pocket 94 and proceeds towards the packing unit 50. Downstream from the output station S18 a drying conveyor (shown schematically in FIG. 9) is arranged that transfers the inner containers 3 to the packing unit 50.

Additional folding means fold the inner blank 38 about the first panel 10' to give the same a cup shape about the first panel 10' itself. Said folding means are preferably constituted by a folding device 95, as hereinafter described in greater detail. The above-mentioned feed station S17 is therefore arranged downstream from the folding device 95. In particular, the folding device 95 is arranged between the devices 70, 71, 72, 73 and the folding feed station S17.

Figure 19:
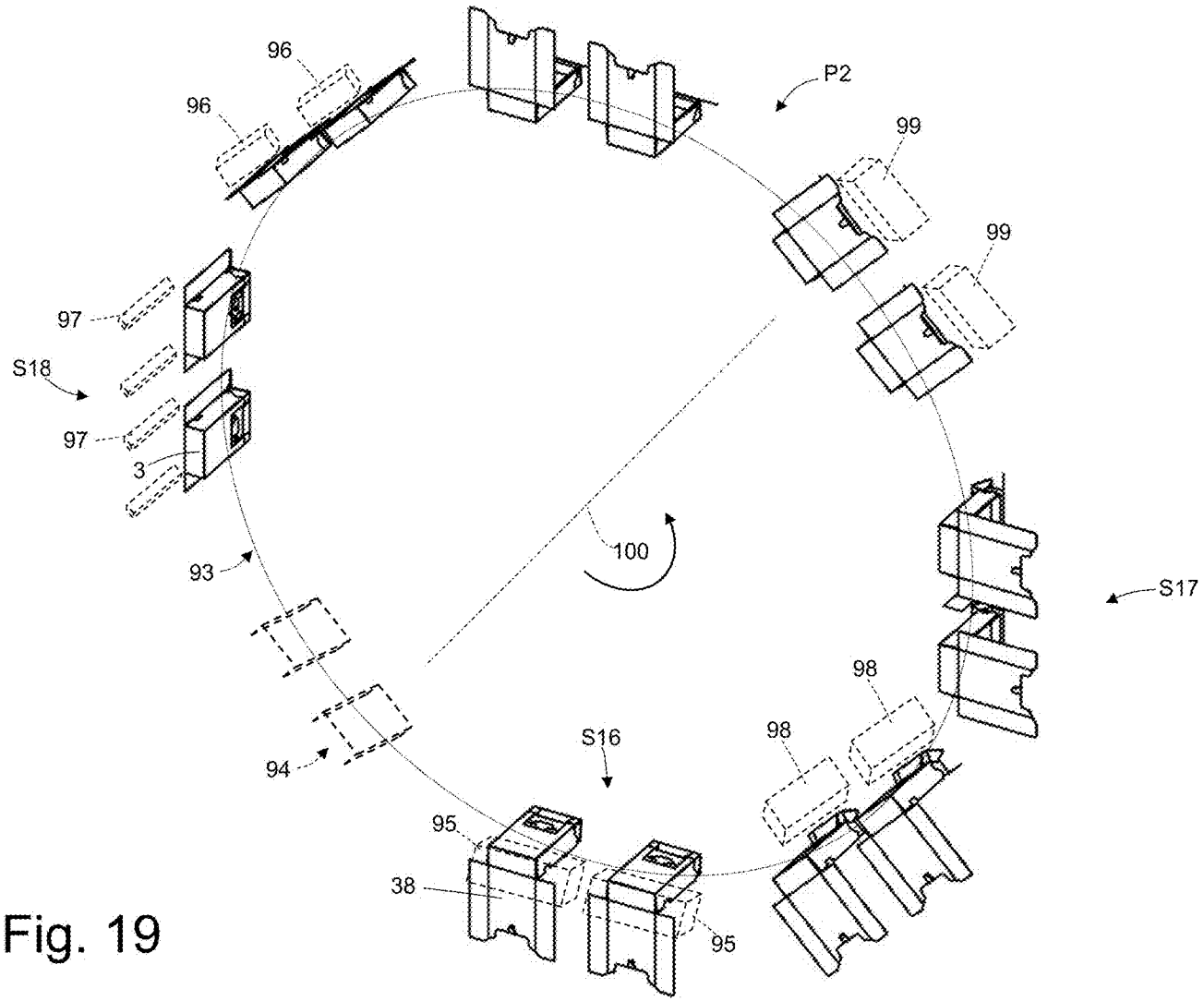
FIG. 19 is a schematic perspective view of a second packing conveyor of the first packing unit of FIG. 10.

As illustrated in FIG. 19, in the input station S16 a folding device 95 is arranged, which folds the tabs 42 of the inner blank 38 by 90°, with respect to the wings 11", and then, by inserting the inner blank 38 into the packing pocket 94, determines the folding of the panel 8' by 90°, with respect to the panel 10' and the folding of the two wings 11" by 90°, with respect to the panel 10'; in other words, after the folding of the tabs 42 by 90°, the input of the inner blank 38 in the packing pocket 94 determines the folding of the panel 8' by 90°, and of the two wings 11" by 90°, with respect to the panel 10' and in this way the tabs 42 rest on the panel 8'.

Between the feed station S17 and the output station S18 a folding device 96 is arranged, which folds the panel 9' by 90°, with respect to panel 8' and about a corresponding transverse fold line 41. The folding of the inner blank 38 is completed in the output station S18, simultaneously with the extraction of the inner container 3 from the packing pocket 94: during the extraction of the inner container 3 from the packing pocket 94 a folding device 97 folds the wings 11' by 90°, with respect to the panel 9', onto the wings 11" and about corresponding longitudinal fold lines 40 completing the formation of the lateral walls 11 of the inner container 3; preferably, a gumming device (not shown) is arranged immediately upstream from the folding device 97 for depositing glue between the wings 11' and 11" immediately before folding the wings 11'.

According to a preferred embodiment shown in FIG. 19, upstream from the feed station S17 an opening device 98 is arranged that by rotating the formed lid 6 in each inner blank 38 about corresponding hinge 7 moves the formed lid 6 from the closing position to the opening position so that in the feed station S17 the respective wrapped group 2 of cigarettes can be inserted more easily into the inner blank 38, in particular, in the feed station S17 the wrapped group 2 of cigarettes can be inserted with a substantially axial (or longitudinal) movement into the inner blank 38. Consequently, downstream from the feed station S17 a closing device 99 is arranged that by rotating the formed lid 6 of each inner blank 38 about corresponding hinge 7 moves the formed lid 6 from the open position to the closed position before continuing folding of the inner blank 38.

Therefore, first the lid 6 of the container 3 is formed. During said forming at least one reinforcing panel, defined by a panel in correspondence with the end of the blank 38 and adjacent to the panels designed to form the lid 6 itself, is superimposed on (and possibly glued) to the panel 10' forming the rear wall 10 of the inner container 3. Further steps of folding the blank 38 confer a cup conformation to the same. Finally, the opening and closing of the formed lid 6 allow the insertion of wrapped group 2 of cigarettes over at least the reinforcing panel 10" of the rear wall 10 of the inner container 3, partially already formed, otherwise not achievable.

The opening device 98 is preferably arranged between the folding device 95 and the feed station S17.

According to a preferred embodiment illustrated in the attached figures, the packing conveyor 93 is constituted by a rotating wheel which rotates by steps about a central axis of rotation 100 arranged horizontally. Consequently, the packing path P2 that extends from the input station S16 to the output station S18 has a circular shape.

As illustrated in FIG. 10, the packing unit 49 comprises a transfer conveyor 101 which transfers the pre-folded inner blanks 38 from the output station S15 of the packing conveyor 54 to the input station S16 of the packing conveyor 93. Along the transfer conveyor 101 and upstream from the input station S16 of the packing conveyor 93 a gumming device 102 that deposits glue between the tabs 42 and the panel 8' of the inner blank 38 is arranged.

According to a preferred embodiment, one inner blank 38 at a time is fed to the packing conveyor 54 in the input station S1 of the packing path P1, and the transfer conveyor 101 transfers two inner blanks 38 at a time from the packing conveyor 54 to the packing conveyor 93; in this embodiment, the packing conveyor 93 at each step treats two inner blanks at a time. According to an alternative embodiment not illustrated, two inner blanks 38 at a time are fed to the packing conveyor 54 in the input station S1 of the packing path P1.

Figure 20:
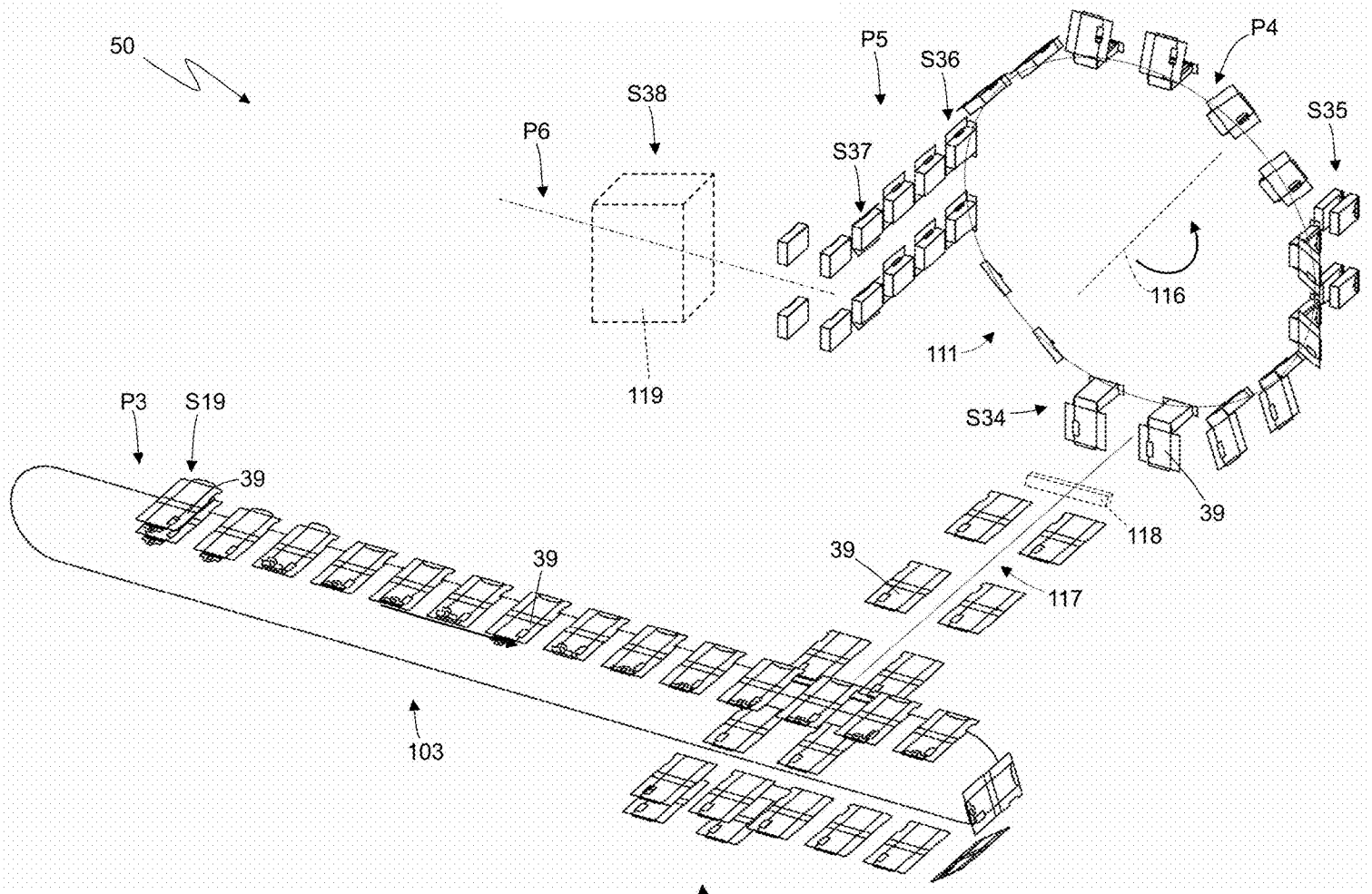
FIG. 20 is a schematic perspective view of a second packing unit of the packing machine of FIG. 9.
Figure 21:
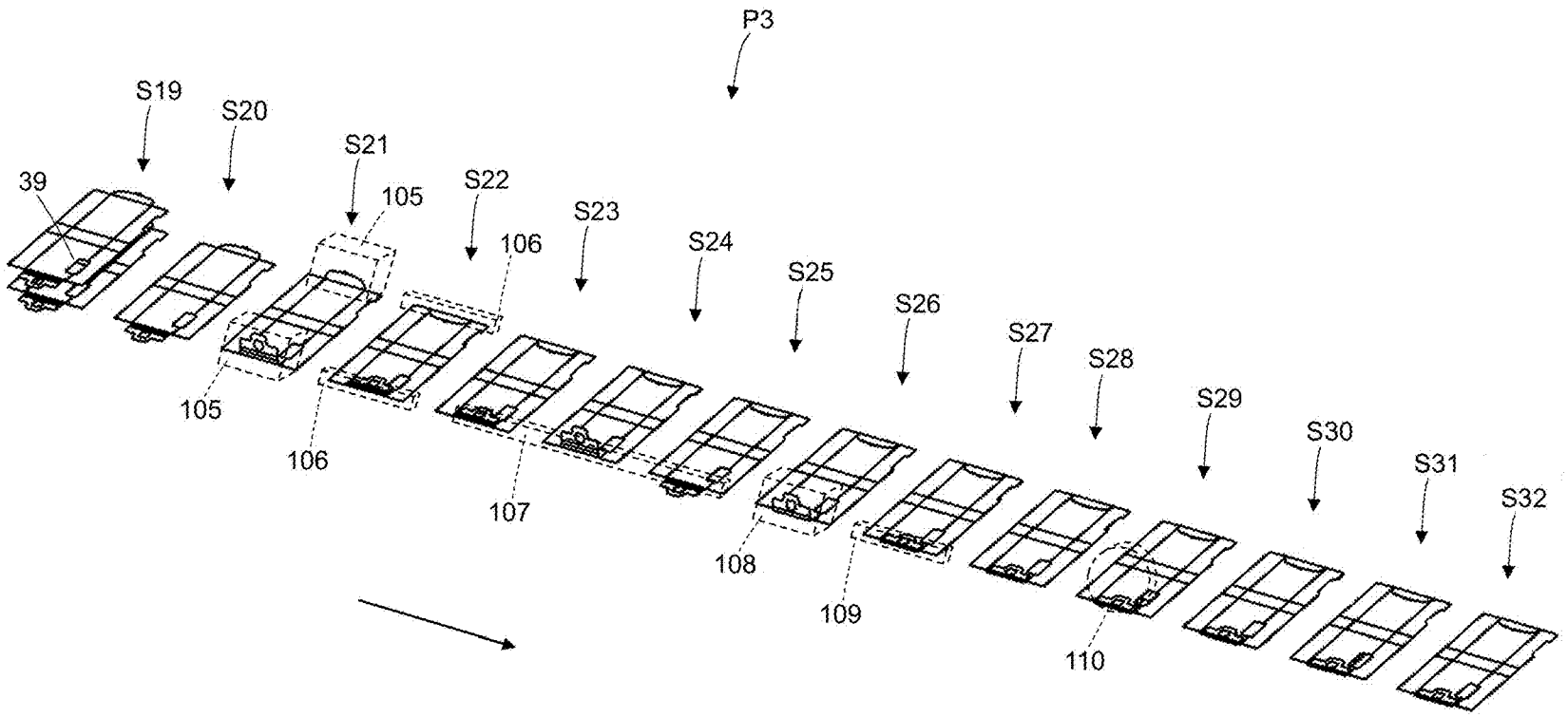
FIG. 21 is a schematic perspective view of a first packing conveyor of the second packing unit of FIG. 20.
Figure 22:
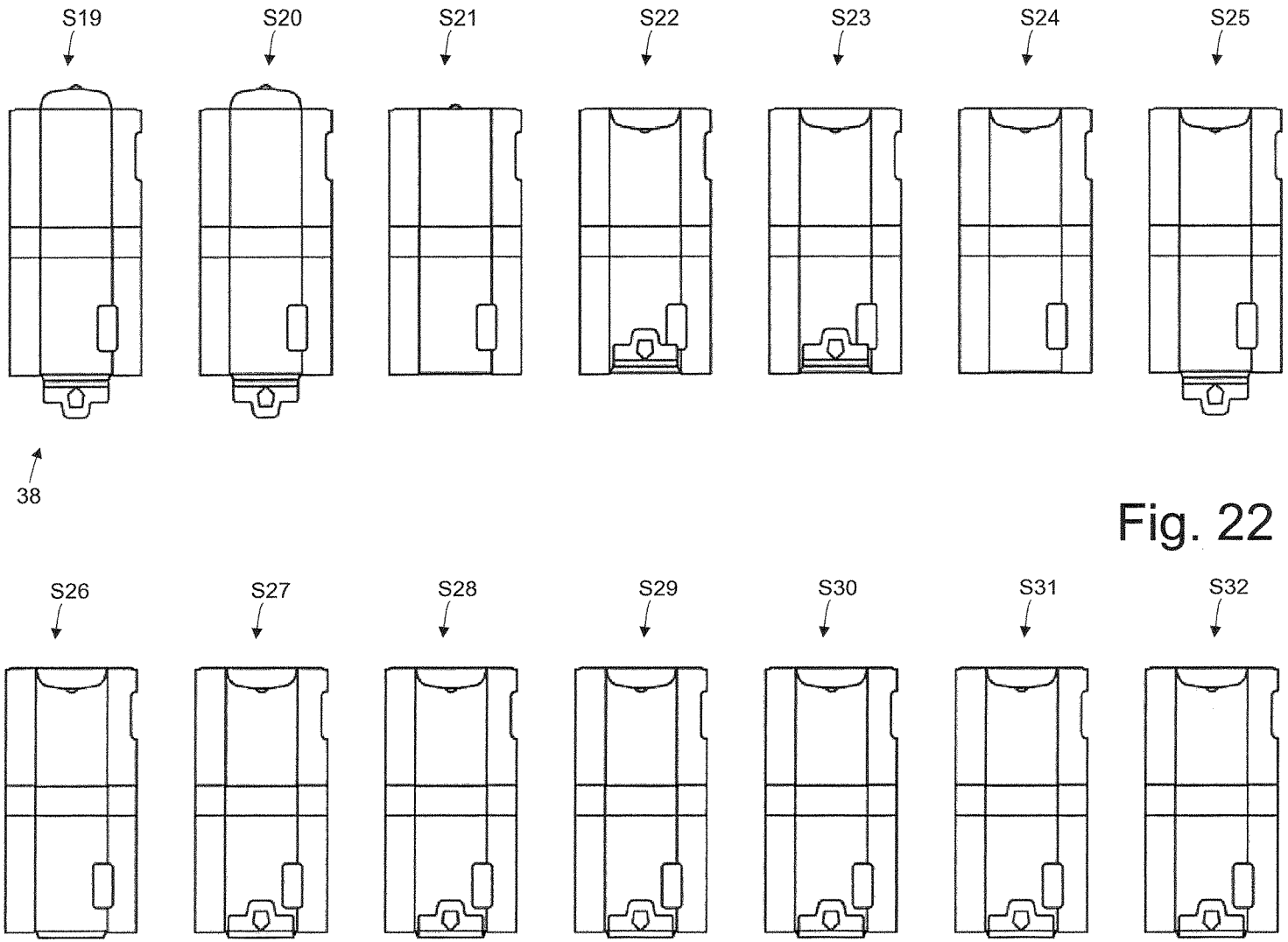
FIG. 22 is a plan view of a sequence of preliminary folding of the outer blank of FIG. 8 operated in the first packing conveyor of FIG. 21.

As illustrated in FIG. 20, the packing unit 50 comprises a packing conveyor 103 that is provided with a number of packing pockets 104 (illustrated in FIG. 23), each of which is adapted to house an outer blank 39 to feed the outer blank 39 by steps (i.e. with intermittent motion composed by a succession of motion phases intercalated with a corresponding succession of stop phases) along a packing path P3 that extends between an input station S19 and an output station S33 through a succession of work stations from S20 to S32 (illustrated in FIGS. 21 and 22).

At the input station S19, a hopper (not shown) is provided, which houses a stack of outer blanks 39 and cyclically feeds the outer blanks 39 from a bottom outlet towards the packing pockets 104 of the packing conveyor 103; in particular, each outer blank 39 arranged at the bottom outlet of the hopper is picked up by a suction gripping head that moves vertically and rests on an underlying packing pocket 104 of the packing conveyor 103 that is stopped waiting in the input station S19 in alignment with the bottom output.

It is important to note that the packing conveyor 103 advances each outer blank 39 along the packing path P3 always transversely, or always with the transverse fold lines 45 parallel to the feed direction, in other words, the packing conveyor 103 does not ever vary the orientation of each outer blank 39 with respect to the feed direction and therefore in all the points of the packing path P3 each outer blank 39 always has its transverse fold lines 45 parallel to the feed direction (and thus their own longitudinal fold lines 44 perpendicular to the feed direction). Always maintaining a constant orientation of each outer blank 39 along the packing path P3 allows to simplify both the folding operations, and the structure of the packing conveyor 103.

Figure 23:
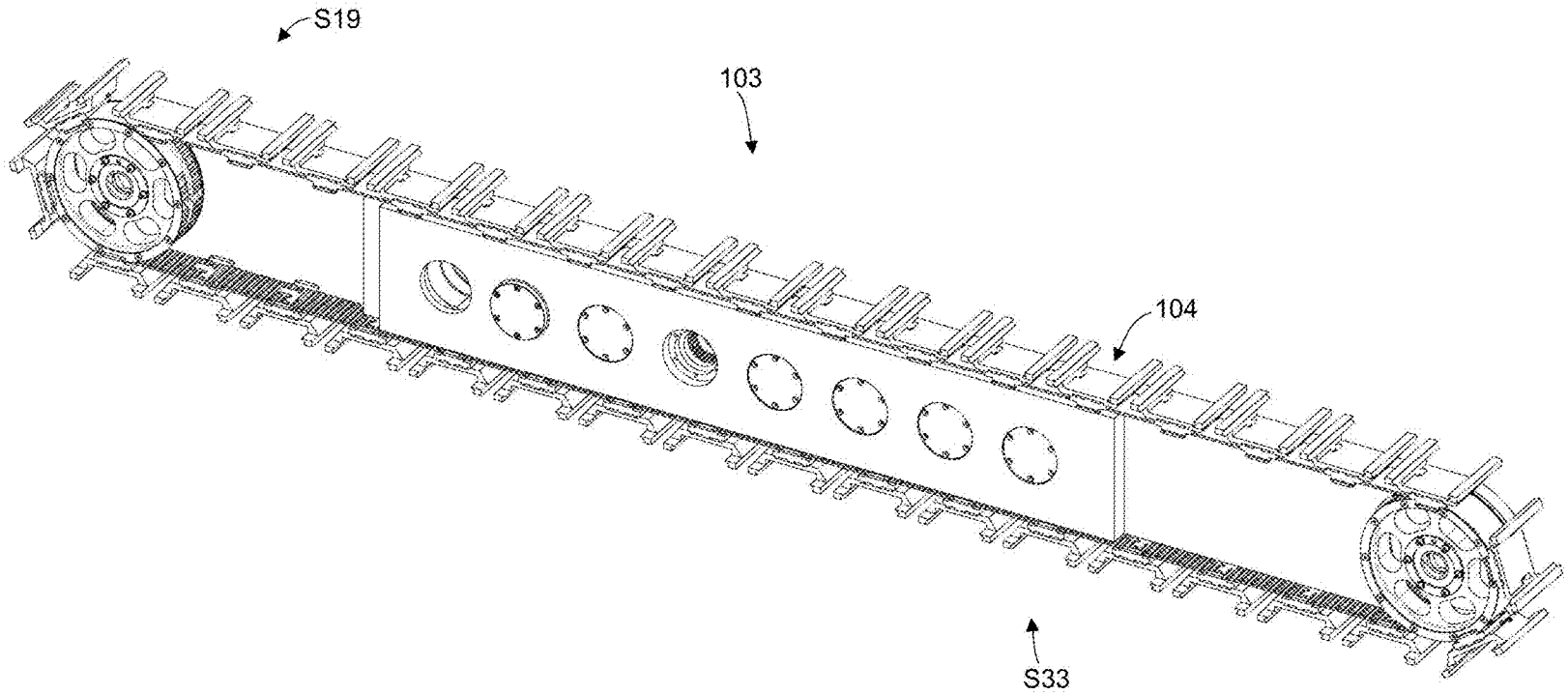
FIG. 23 is a schematic and perspective view of a belt conveyor of the first packing unit of FIG. 20.

According to a preferred embodiment shown in FIG. 23, the packing conveyor 103 is constituted by a conveyor belt that is wrapped about two end pulleys and supports a number of packing pockets 104; accordingly, the packing path P3 has an "U" shape and extends between the input station S19 arranged along an initial portion of the rectilinear packing path P3 and the output station S33 arranged along a final portion of the rectilinear packing path P3 that is connected to the initial straight portion by way of an intermediate semicircular portion.

As illustrated in FIG. 21, in the work station S21 a folding device 105 is provided having movable parts (i.e. parts that move to perform the folding operation while the outer blank 39 is stopped waiting in the work station S21); the folding device 105 simultaneously folds by 90° the appendix 37' with respect to connecting tab 37 and about a corresponding transverse fold line 45, the connecting tab 37 with respect to the panel 18' and about a corresponding transverse fold line 45, and the sealing tab 22 with respect to the panel 17' and about a corresponding transverse fold line 45.

At the work station S22 a folding device 106 is provided having fixed folding profiles (i.e. folding helixes that are devoid of moving parts and perform the folding operation while the outer blank 39 moves in the packing path P3 and thus exploiting the feeding movement of the outer blank 39), the folding device 106 of folds the connecting tab 37 by further 90° (for a total of 180°) and simultaneously with respect to the panel 18' and about a corresponding transverse fold line 45 to rest the connecting tab 37 on the panel 18' (while the appendix 37' is folded on the opposite side of the tab 37 with respect to the panel 18'), and the sealing tab 22 with respect to the panel 17' and about a corresponding transverse fold line 45 to rest the sealing flap 22 on the panel 17'.

Between the work station S23 and the work station S25 a folding device 107 is provided having fixed folding profiles (i.e. folding helixes that are devoid of moving parts and perform the folding operation while the outer blank 39 moves in the packing path P3 and thus exploiting the feeding movement of the outer blank 39); the folding device 107 folds the sealing tab 22 by 180°, with respect to the panel 17' with opposite direction with respect to the previous folds performed by the folding devices 105 and 106. The folding device 107 and the two folding devices 105 and 106 (when acting on the sealing tab 22) perform two opposite folding operations (i.e. that cancel each other) having a flex function of (i.e. weakening to considerably reduce the residual spring back force) the outer blank 39 along the corresponding transverse fold line 45. Therefore, the function of the folding devices 105, 106 and 107 (when acting on the sealing tab 22) is not to perform an actual folding of the outer blank 39, but to prepare the outer blank 39 for the successive folding operations (described below).

In the work station S26 a folding device 108 is provided having movable parts (i.e. parts that move to perform the folding operation while the inner blank 39 is stopped waiting in the work station S26); the folding device 108 folds the connecting tab 26 by 90°, with respect to the sealing tab 22 and the about a corresponding transverse fold line 45.

In the work station S27 a device 109 for folding is provided having fixed folding profiles (i.e. folding helixes that are devoid of moving parts and perform the folding operation while the outer blank 39 moves in the packing path P3 and thus exploiting the feeding movement of the outer blank 39), the folding device 109 folds the connecting tab 26 by a further 90° (for a total of 180°) with respect to the sealing tab 22 and about a corresponding transverse fold line 45 to rest the connecting tab 26 on the sealing tab 22 (and thus to rest the actuating tab 24 on the panel 17').

In the work station S29 a rotating presser device 110 is arranged (i.e. consisting of a rotatable drum that by rotating "rolls" an outer surface on the inner blank 38 while the inner blank 38 moves in the packing path P3) that locally flattens the outer blank 39 by pressing on the connecting tab 26 to press the folding of the connecting tab 26 again onto the sealing tab 22.

As illustrated in FIG. 20, the packing unit 50 comprises a packing conveyor 111 that is provided with a number of packing pockets. 112 (illustrated schematically in FIG. 24), each of which is adapted to accommodate an outer blank 39 and the corresponding inner container 3 for feeding the outer blank 39 and the inner container 3 along a packing path P4 that extends between an input station S34 and an output station S36.

At the input station S34, an outer blank 39 partially pre-folded and coming from the packing conveyor 103 is fed into a packing pocket 112 causing a further folding of the outer blank 39 itself. At a feed station S35 arranged between the input station S34 and the output station S36, an inner container 3 is fed into a packing pocket 112 to be coupled to the outer blank 39 previously feed; in particular, the rear wall 10 of the inner container 3 rests to the panel 18' of the outer blank 39. At the output station S36, the outer container (formed by folding the outer blank 39 about the inner container 3) almost completely full is extracted from the packing pocket 112 and proceeds along a further packing path P5 and a drying path P6 arranged in succession, and then through two more work stations S37 and S38 arranged downstream from the packing conveyor 111. The drying path P6 is defined by a drying conveyor (shown schematically in FIG. 9) that transfers the outer containers 4 towards an outlet of the packing machine 47.

Figure 24:
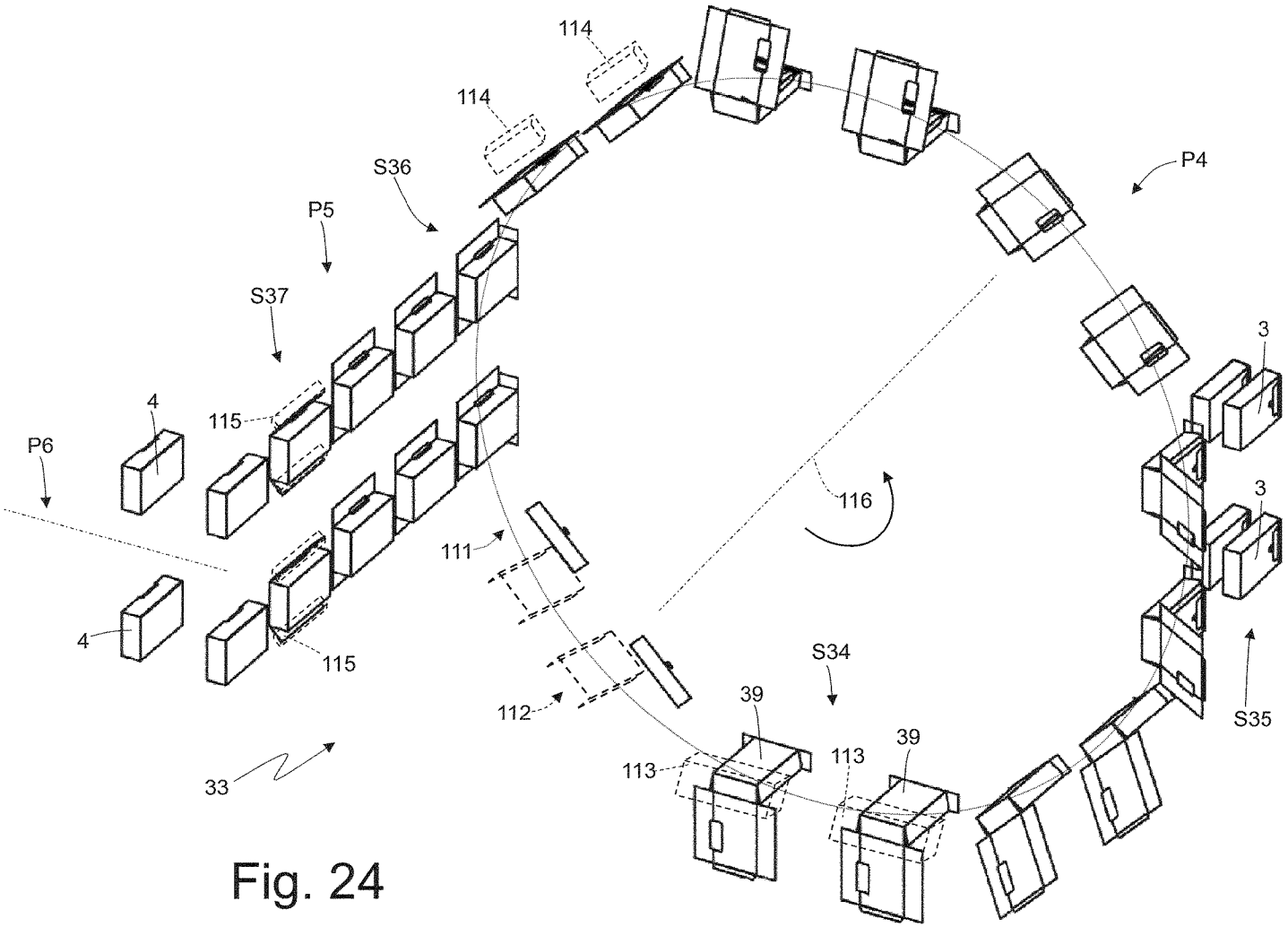
FIG. 24 is a schematic and perspective view of a second packing conveyor of the second packing unit of FIG. 20.

As illustrated in FIG. 24, in the input station S34 a folding device 113 is arranged, which folds the tabs 46 of the outer blank 39 by 90°, with respect to the wings 19", and then, by inserting the outer blank 39 into the packing pocket 112, determines the folding of the panel 15' by 90° with respect to the panel 18' and the folding of the two wings 19" by 90° with respect to the panel 18'; in other words, after the folding of the tabs 46 by 90°, the input of the outer blank 39 in the packing pocket 112 determines the folding of the panel 15' and the two wings 19" by 90° with respect to the panel 18' and in this way the tabs 46 rest on the panel 15'.

Between the feed station S35 and the output station S36 a folding device 114 is arranged, which folds the panel 17' by 90° with respect to panel 15' and about a corresponding transverse fold line 45. The folding of the outer blank 39 is completed in the work station S37 after the extraction of the outer container 4 from the packing pocket 112 (i.e. downstream from the output station S36); in the work station S37 a folding device 115 folds by 90° the wings 19' with respect to the panel 17', onto the wings 19" and about corresponding longitudinal fold lines 44 completing the formation of the lateral walls 19 of the outer container 4; preferably, a gumming device (not shown) is arranged immediately upstream from the folding device 115 for depositing glue between the flanges 19' and 19" immediately before the folding of the wings 19'.

According to a preferred embodiment illustrated in the attached figures, the packing conveyor 111 is constituted by a rotating wheel which rotates by steps about a horizontally arranged central axis of rotation 116. Consequently, the packing path P4 that extends from the input station S34 to the output station S36 has a circular shape. The packing path P5 and the subsequent drying path P6 are rectilinear and arranged perpendicularly one to the other.

As illustrated in FIG. 20, the packing unit 50 comprises a transfer conveyor 117 which transfers the pre-folded outer blanks 39 from the output station S33 of the packing conveyor 103 to the input station S34 of the packing conveyor ill. Along the transfer conveyor 119 and upstream from the input station S34 of the packing conveyor 111 a gumming device 118 is arranged which deposits glue between the tabs 46 and the panel 15' of the outer blank 39.

According to a preferred embodiment, an outer blank 39 at a time is fed to the packing conveyor 103 in the input station S19 of the packing path P3, and the transfer conveyor 117 transfers two outer blanks 39 at a time from the packing conveyor 103 to the packing conveyor 111, in this embodiment, the packing conveyor 111 treats at each step two outer blanks at a time. According to an alternative embodiment not illustrated, two outer blanks at a time 39 are fed to the packing conveyor 103 in the input station S19 of the packing path P3.

As illustrated in FIG. 20, in the work station S38 a folding device 119 of the type described in Italian patent application BO2011A000632 is arranged. During folding of the outer blank 39 about the inner container 3, the sealing tab 22 is not bent so as to leave the sealing tab 22 in an initial position wherein the sealing tab 22 is coplanar with the front wall 17 of the outer container 4; in other words, when the outer container 4 enters in the work station S38 the sealing tab 22 is coplanar with the front wall 17 of the outer container 4. The folding device 119 partially extracts the inner container from the outer container 4 by way of a sliding movement between the inner container 3 and the outer container 4, successively the folding device 119 folds the sealing tab 22 by 90°, about a corresponding and transverse fold line 45 towards the inner container 3 to arrange the sealing tab 22 in the work position under the top wall 12 of the lid 6 of the inner container 3, and finally the folding device 119 fully inserts the inner container 3 in the outer container 4 by way of a sliding movement between the inner container 3 and the outer container 4. For a more detailed description of the operation of the folding device 119 refer to what is described in Italian patent application BO2011A000632.

According to a preferred embodiment shown in FIGS. 7 and 8, the blanks 38 and 39 show alignment through windows 120 which are arranged at the lateral periphery of the blanks 38 and 39 (i.e. in correspondence to the wings 11" and 19") and have the function to ensure proper longitudinal alignment of the blanks 38 and 39 when the blanks 38 and 39 themselves are inserted into the corresponding packing pockets 55 and 104 of the packing conveyors 54 and 103. In other words, the packing pockets 55 and 104 of the packing conveyors 54 and 103 have reference bodies that reproduce in negative the shape of the alignment windows 120 and are inserted within the alignment windows 120 when the blanks 38 and 39 are inserted into the corresponding packing pockets 55 and 104; in this way a correct longitudinal alignment of the blanks 38 and 39 within the corresponding packing pockets 55 and 104 is ensured.

Figure 25:
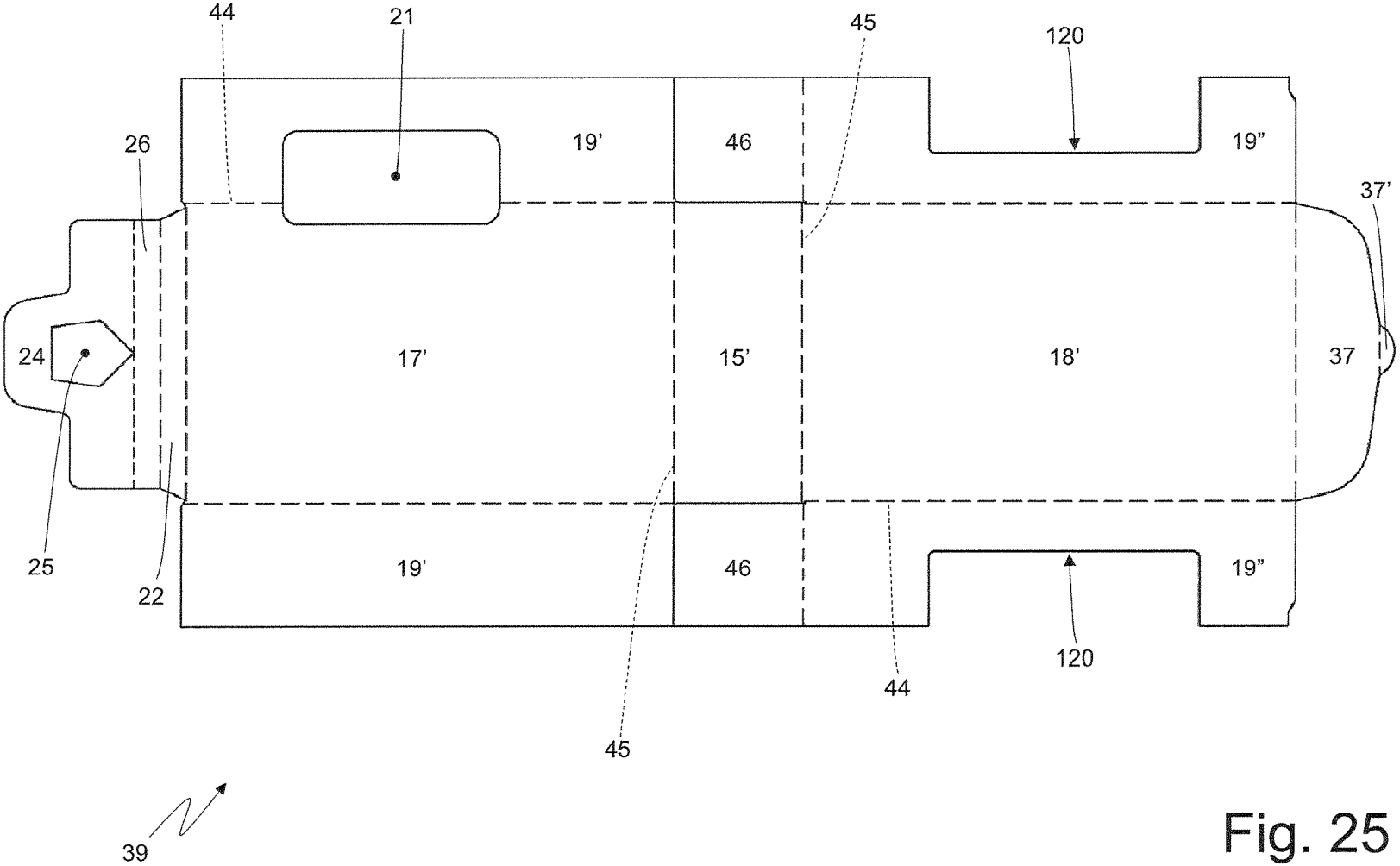
FIG. 25 is a plan view of a variant of the outer blank of FIG. 8.

In FIG. 25 a variant of the outer blank 39 is shown that, with respect to the outer blank 39 shown in FIG. 8, has a different shape and position of the alignment windows 120. It is important to note that the alignment windows 120 are formed in the wings 11" and 19" which constitute an inner portion of the lateral walls 11 and 19; then the alignment windows 120 are not visible (i.e. are covered by the wings 11' and 19') in the inner container 3 and in the outer container 4.

The through window 21 of the wing 19' of the outer blank 39 adapted to allow the user to apply the necessary thrust to slide the inner container. 3 with respect to the outer container 4 (FIG. 2) must not be limited by the alignment window 120 of the corresponding wing 19" of the outer blank 39. In other words, the alignment window 120 which faces the through window 21 should have a greater dimension than the through window 21 itself, as shown in FIGS. 8 and 25.

The packing method and the corresponding packing machine 47 described above have many advantages, as they allow to produce the slide-open packages 1 with a hinged lid with high productivity (i.e. with a high number of packages 1 of cigarettes produced per unit of time) while maintaining a high quality standard. This result is obtained thanks to the conformation of the packing units 49 that by completing the formation of the lid 6 in the packing conveyor 54 (i.e. before coupling the inner blank 38 to the wrapped group 2 of cigarettes) allows to form the lid 6 in a simple and effective way and simultaneously allows to greatly simplify the folding of the inner blank 38 about the wrapped group 2 of cigarettes. In particular, the formation of the lid 6 is easier (and therefore simple and fast) along a straight packing path (as, indeed, is the packing path P1 of the packing conveyor 54), while the folding of the inner blank 38 about the wrapped group 2 of cigarettes is easier (and therefore simple and fast) along a circular packing path (as, indeed, is the packing path P2 of the packing conveyor 93). So, thanks to the conformation of the packing units 49 all the folding operations can be performed in the most favorable situation, and therefore can be performed quickly (i.e. with a high productivity of the packing process) while ensuring a high quality standard.

Additionally, but not less important, the packing method and the corresponding packing machine 47 described above are extremely "flexible", i.e. allow to vary quickly and simply the type of slide-open packages 1 of cigarettes that are produced (with the hinged lid 6 comprised in the inner blank 38 or comprised in the outer blank 39 or without hinged lid). Among other things, the high flexibility is provided by the fact that in each packing unit 49 or 50 there is a first packing conveyor 54 or 103 wherein a preliminary folding of the inner blank 38 or outer blank 39 is performed and a second packing conveyor 93 or 111 wherein the preliminary folding of the inner blank 38 or outer blank 39 is completed; in fact, thanks to the presence of the first packing conveyor 54 or 103 it is relatively simple to perform the preliminary folding of the inner blank 38 or outer blank 39 to form a lid, and once the lid is formed the final folding of the inner blank 38 or outer blank 39 is "conventional" (i.e. analogous to the folding of a standard blank) and therefore devoid of particular complications.

Finally, it is important to observe that the two packing units 49 and 50 are very similar to each other: both packing units 49 and 50 have the same structure that comprises a first packing conveyor (the packing conveyors 54 and 103) consisting in a conveyor belt and intended to produce a preliminary folding of the blank, a second packing conveyor (the packing conveyors 93 and 111) consisting in a wheel and intended to fold the blank (already partially folded) about the content, and a transfer conveyor (the transfer conveyors 101 and 117) that connects the two packing conveyors. Furthermore, the two second packing conveyors (the packing conveyors 93 and 111) of the two packing units 49 and 50 perform almost all the packing operations in the same way and in the same areas. Finally, the two packing units 49 and 50 can share between one another a large number of components, i.e. the same identical component is frequently present in both packing units 49 and 50 (in particular, the two packing units 49 and 50 can have in common at least 70-80% of the components); in this way, it is possible to break down in a very significant way the production, assembly and maintenance cost, of the packing machine 47.

The invention claimed is:

1. A packing machine for producing an inner container by folding an inner blank about a wrapped group of tobacco articles;

wherein the inner container is cup-shaped, has one open upper end and is provided with a lid, which is hinged to a rear wall of the inner container along a hinge to rotate, with respect to the inner container, between an open position and a closed position of the open upper end; and wherein the inner blank has two longitudinal fold lines and a number of transverse fold lines which define, between the two longitudinal fold lines, at least a first panel forming the rear wall of the inner container, a second panel forming a front wall of the inner container, a third panel forming a bottom wall of the inner container, a fourth panel forming a rear wall of the lid, a fifth panel forming a top wall of the lid, a sixth reinforcing panel for the fifth panel, a seventh reinforcing panel for the fourth panel and an eighth reinforcing panel for the first panel;

the packing machine comprises:

first folding means which fold the inner blank to form the lid;

a feed station which couples the partly folded inner blank to the wrapped group of tobacco articles so that a rear wall of the wrapped group of tobacco articles rests on the first panel;

second folding means arranged downstream from the feed station, which further fold the inner blank about the wrapped group of tobacco articles to complete the production of the inner container;

an opening device arranged upstream of the feed station, which rotates the formed lid from the closed position to the open position; and a closing device arranged between the feed station and the second folding means, which rotates the formed lid from the open position to the closed position, wherein the first folding means overlap at least the eighth reinforcing panel at least on the first panel during the forming of the lid.

2. The packing machine according to claim 1, further comprising third folding means which fold the inner blank about the first panel to impart to the inner blank a cup shape about the first panel, wherein the opening device is arranged between the third folding means and the feed station.

3. The packing machine according to claim 2, wherein the feed station is arranged downstream from the third folding means.

4. The packing machine according to claim 2, wherein the third folding means are arranged between the first folding means and the feed station.

5. The packing machine according to claim 2, wherein the first panel has a pair of first wings, which form respective inner portions of lateral walls of the inner container, arranged on opposite sides of the first panel, and connected to the first panel by the longitudinal fold lines; and each first wing has a tab which is connected to each respective first wing by a transverse fold line;

the third folding means fold the tabs by 90° with respect to the pair of first wings, fold the third panel by 90° with respect to the first panel and fold the pair of first wings by 90° with respect to the first panel.

6. The packing machine according to claim 5, wherein the third folding means fold the tabs by 90° with respect to the pair of first wings and then insert the inner blank in a packing pocket for folding the third panel by 90° and for folding the pair of first wings with respect to the first panel.

7. The packing machine according to claim 5, wherein the second panel has a pair of second wings, which form respective outer portions of the lateral walls of the inner container, arranged on opposite sides of the second panel, and connected to the second panel by the longitudinal fold lines; and the second folding means fold the pair of second wings by 90° with respect to the second panel against the pair of first wings and about corresponding longitudinal fold lines to complete the formation of the lateral walls of the inner container.

8. The packing machine according to claim 1, wherein the first folding means form the lid from a part of the inner blank, leaving the other parts of the inner blank flat.

9. The packing machine according to claim 1, wherein the second folding means fold by 90° the second panel with respect to the third panel.

10. A packing machine for producing an inner container by folding an inner blank about a wrapped group of tobacco articles;

wherein the inner container is cup-shaped, has one open upper end and is provided with a lid, which is hinged to a rear wall of the inner container along a hinge to rotate, with respect to the inner container, between an open position and a closed position;

the packing machine comprises:

first folding means which fold the inner blank to form the hinged lid from a part of the inner blank, leaving the other parts of the inner blank flat;

third folding means which fold the inner blank about a first inner panel corresponding to the rear wall of the inner container to impart to the inner blank a cup shape about the first inner panel;

a feed station arranged downstream from the third folding means, which couples the wrapped group of tobacco articles to the partially folded inner blank so that a rear wall of the wrapped group of tobacco articles rests on the first inner panel of the inner blank;

second folding means arranged downstream from the feed station, which further fold the inner blank about the wrapped group of tobacco articles to complete the production of the inner container;

an opening device arranged between the third folding means and the feed station, which rotates the lid of the inner blank about the hinge to move the lid from the closed position to the open position; and a closing device arranged between the feed station and the second folding means, which rotates the lid of the inner blank about the hinge to move the lid from the open position to the closed position.

11. A packing method for producing an inner container by folding an inner blank about a wrapped group of tobacco articles;

wherein the inner container is cup-shaped, has one open upper end and is provided with a lid, which is hinged to a rear wall of the inner container along a hinge to rotate, with respect to the inner container, between an open position and a closed position of the open upper end;

wherein the inner blank has two longitudinal fold lines and a number of transverse fold lines which define, between the two longitudinal fold lines, at least a first panel forming the rear wall of the inner container, a second panel forming a front wall of the inner container, a third panel forming a bottom wall of the inner container, a fourth panel forming a rear wall of the lid, a fifth panel forming a top wall of the lid, a sixth reinforcing panel for the fifth panel, a seventh reinforcing panel for the fourth panel and an eighth reinforcing panel for the first panel;

the packing method comprises the steps of:

folding, by first folding means, the inner blank to form the lid;

coupling, in a feed station, the partly folded inner blank to the wrapped group of tobacco articles so that a rear wall of the wrapped group of tobacco articles rests on the first panel;

further folding, by second folding means arranged downstream from the feed station, the inner blank about the wrapped group of tobacco articles to complete the production of the inner container;

superimposing at least the eighth reinforcing panel at least on the first panel during the forming of the lid, by way of the first folding means;

rotating, by way of an opening device which is arranged upstream of the feed station, the formed lid from the closed position to the open position; and rotating, by way of a closing device which is arranged between the feed station and the second folding means, the formed lid from the open position to the closed position.

12. A packing method for producing an inner container by folding an inner blank about a wrapped group of tobacco articles;

wherein the inner container is cup-shaped, has one open upper end and is provided with a lid, which is hinged to a rear wall of the inner container along a hinge to rotate, with respect to the inner container, between an open position and a closed position, the packing method comprises the steps of:

folding, by way of first folding means, the inner blank to form the lid from a part of the inner blank leaving the other parts of the inner blank flat;

folding, by way of third folding means, the inner blank about a first panel corresponding to the rear wall of the inner container to impart to the inner blank a cup shape about the first panel;

coupling, in a feed station arranged downstream from the third folding means, the wrapped group of tobacco articles to the partially folded inner blank so that a rear wall of the wrapped group of tobacco articles rests on the first panel of the inner blank;

further folding, by second folding means arranged downstream from the feed station, the inner blank about the wrapped group of tobacco articles to complete the production of the inner container;

rotating, by way of an opening device that is arranged between the third folding means and the feed station, the lid of the inner blank about the hinge to move the lid from the closed position to the open position; and rotating, by way of a closing device, which is arranged between the feed station and the second folding means, the lid of the inner blank about the hinge to move the lid from the open position to the closed position.

* * * * *